US012037085B2

(12) United States Patent
Hagen

(10) Patent No.: US 12,037,085 B2
(45) **Date of Patent: *Jul. 16, 2024**

(54) STEERABLE HYDROFOIL WATERCRAFT

(71) Applicant: Terry Lee Hagen, Indio, CA (US)

(72) Inventor: Terry Lee Hagen, Indio, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/220,807

(22) Filed: Jul. 11, 2023

(65) Prior Publication Data

US 2023/0356809 A1 Nov. 9, 2023

Related U.S. Application Data

(63) Continuation of application No. 17/858,890, filed on Jul. 6, 2022, now Pat. No. 11,731,741.

(60) Provisional application No. 63/218,851, filed on Jul. 6, 2021.

(51) Int. Cl.

| | |
|---|---|
| ***B63B 32/10*** | (2020.01) |
| ***B63B 1/28*** | (2006.01) |
| ***B63B 32/60*** | (2020.01) |
| ***B63B 32/64*** | (2020.01) |
| ***B63H 25/02*** | (2006.01) |

(52) U.S. Cl.

CPC ..... *B63B 32/10* (2020.02); *B63B 32/60* (2020.02); *B63B 32/64* (2020.02); *B63B 1/285* (2013.01); *B63H 2025/026* (2013.01)

(58) Field of Classification Search

CPC ..... B63B 1/28; B63B 2001/281; B63B 1/283; B63B 1/285; B63B 1/286; B63B 32/10; B63B 32/60; B63B 32/64; B63B 32/66; B63B 34/10; B63B 34/40; B63H 2025/026

See application file for complete search history.

(56) References Cited

U.S. PATENT DOCUMENTS

| | | | |
|---|---|---|---|
| 7,568,443 | B2 | 8/2009 | Walker |
| 8,060,265 | B2 | 11/2011 | Hallenstvedt et al. |
| 8,701,583 | B2 | 4/2014 | Boschoff et al. |
| 8,720,354 | B2 | 5/2014 | Ketterman et al. |
| 10,099,754 | B2 | 10/2018 | Tian |

(Continued)

FOREIGN PATENT DOCUMENTS

| | | | |
|---|---|---|---|
| CH | 709502 | 10/2015 | |
| DE | 102014005314 A1 * | 10/2015 | ..... B63B 1/286 |

(Continued)

*Primary Examiner* — Ajay Vasudeva

(74) *Attorney, Agent, or Firm* — Innovent Law P.C; Karima Gulick

(57) ABSTRACT

A hydrofoil watercraft system comprising: a flotation device; a downward mast extending from a bottom surface of the flotation device; a fuselage, a foil wing extending from one first end of the fuselage; and a plurality of fins independently movable independent of one another, wherein at least two of the movable fins extend in opposite directions from one second end of the fuselage, where the movable fins are used for steering the watercraft. The system further includes a controller for receiving user input, wherein the controller drives the movable fins respectively based on the user input. One of the movable fins is driven by the controller to rotate along a first axis while another of the movable fins is driven by the controller to rotate along a second axis, wherein the first axis and the second axis are substantially symmetrical with respect to the fuselage.

20 Claims, 30 Drawing Sheets

(56) References Cited

U.S. PATENT DOCUMENTS

| | | | | |
|---|---|---|---|---|
| 11,731,741 | B2 * | 8/2023 | Hagen | B63B 32/64<br>114/274 |
| 2023/0043812 | A1 * | 2/2023 | Yanai | G05D 1/0875 |

FOREIGN PATENT DOCUMENTS

| | | | |
|---|---|---|---|
| KR | 2017/0004558 | | 1/2017 |
| WO | 2018/234969 | | 12/2018 |
| WO | 2019/091437 | | 5/2019 |
| WO | WO-2020176033 | A1 * | 9/2020 |
| WO | WO-2021191729 | A1 * | 9/2021 |

* cited by examiner

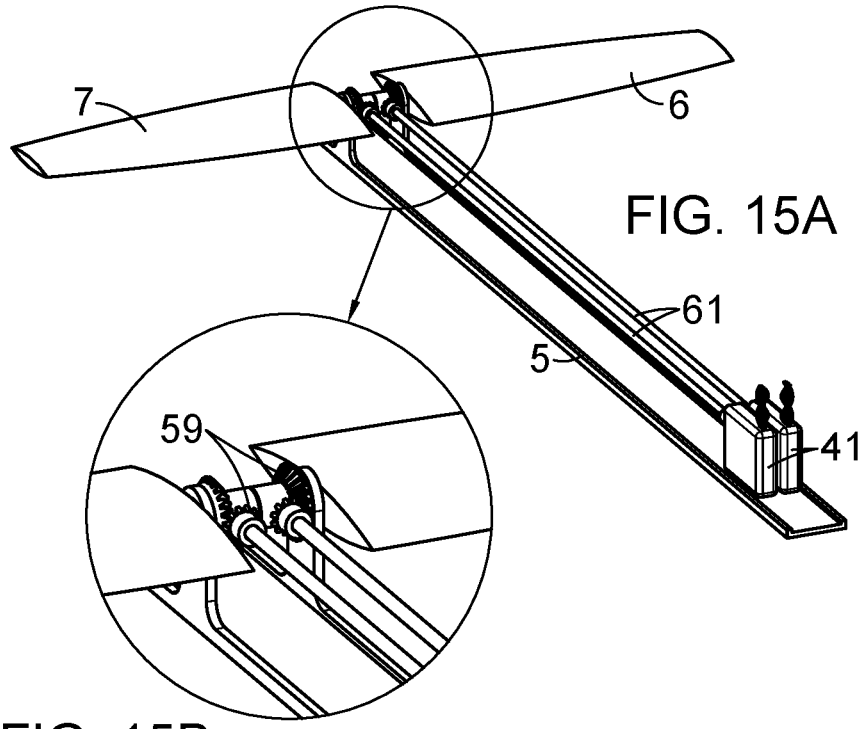
FIG. 15A
FIG. 15B
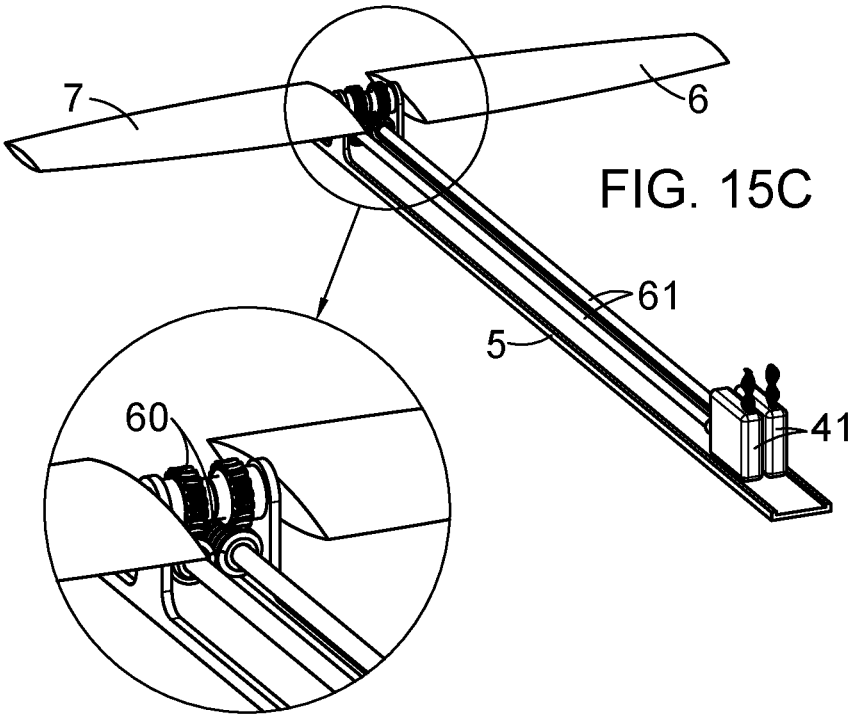
FIG. 15C
FIG. 15D

STEERABLE HYDROFOIL WATERCRAFT

CROSS-REFERENCE TO RELATED APPLICATIONS

This application incorporates by reference and claims the benefit of priority to U.S. Non-Provisional application Ser. No. 17/858,890 filed Jul. 6, 2022.

FIELD OF THE INVENTION

The present invention relates to personal watercraft and remote controlled watercraft, specifically a motorized powered or non-motorized hydrofoil with a steering system.

BACKGROUND OF THE INVENTION

A recent development in watercraft technology is the attachment of a hydrofoil and a motor to a flotation device, typically a surfboard. These systems include a motor and a hydrofoil in combination. The hydrofoil elevates the board clear of the water under power from the motor, reducing drag and providing high speed travel over the water.

The hydrofoil and motor are typically positioned towards the lower end of a mast, while the upper end of the mast is bolted to the underside of the flotation device. One method of developing such a system has been to take an existing hydrofoil surfboard and attach a motor to part of the mast.

A major factor that distinguishes hydrofoil surfboards from other watercraft is that control (both direction and elevation above the water) is affected via weight shift rather than by moveable surfaces (fins) on the hydrofoil. Indeed, other methods of transport (skateboards and snowboards) also rely heavily on weight shift. In fact, the weight shift method of control is central to the experience of surfing, snowboarding, and skateboarding.

Sporting enthusiasts who have physical limitations or disabilities may not be able to master the weight shifting and balance necessary to operate a regular hydrofoil surfboard. Therefore, there remains a need for a new and improved motorized (or non-motorized) hydrofoil device with steering that controls both direction and elevation above the water, thereby reducing or eliminating the need for weight shifting.

SUMMARY OF THE INVENTION

Embodiments of the present invention provide steering control for a hydrofoil device (motorized or non-motorized), to reduce or eliminate the need for body weight shifting to control the steering. Further, the present steering control allows for improved control of the hydrofoil device in the standing position, and greatly improves control in the prone, kneeling, and sitting positions, wherein the ability to shift ones weight is reduced.

Hydrofoil devices typically consist of a flotation device (or surfboard), attached to the top of a downward or vertical mast. At the bottom of the mast is usually a horizontal fuselage, with a large horizontal hydrofoil wing at one end and a small horizontal fin at the other end. If motorized, the motor can be affixed to the mast above the fuselage, incorporated into the fuselage, or incorporated into the large hydrofoil wing. Numerous configurations and combinations exist, and several different embodiments are disclosed. By separating the smaller fin into two independent control surfaces (fins), one on each side of the fuselage, steering control can be achieved. This provides the ability to bank/roll left or right, when the two small fins are rotated in opposite directions to each other. When the two small fins are rotated together, an up or down movement is achieved. By initially banking left or right, and then pulling up, a turn can be executed.

In an example, the steering control, can be performed with a portable remote, that can be held in one hand. Steering can be accomplished with a two axis joystick, with the operator's thumb. The two axis/channel joystick, uses two position sensors (potentiometers/position encoders) attached to a joystick mechanism for controlling the movement and position of the two small fins. A microcontroller can be used to receive the two channel joystick position input, and transmit a signal to servos (or other motorized device) to drive the two small fins. For the motorized hydrofoil the portable remote can have a throttle control managed with the index finger, and may include a display for information related to the propulsion system and batteries. One or more buttons can be used to cycle through the different display screens, adjusting the trim (neutral position) of the two small fins, and for setting speed cruise control.

In an example, a steering control joystick is mounted to the top of the flotation device. The joystick can tilt back and forth, as well as tilt left and right, and has a throttle control lever operated with the index finger, and a display at the top of the joystick.

In an example, the mounted steering control joystick, uses two position sensors (potentiometers/position encoders) for controlling the movement and position of the two small fins, which are driven by two servos.

In an example, the mounted steering control joystick, uses a mechanical apparatus for controlling the movement and position of the two small fins. The mechanical apparatus can be a joystick mechanism, control arms and push-pull cables, control arms and push rods, or any suitable mechanical apparatus.

In an example, the seated flotation device is shaped like in a small compact one person boat, where the operator is in the seated position, sunk down into the flotation device, resulting in improved stability in the water, due to the overall center of gravity being below the center of buoyancy. After a fall, the flotation device and operator (if held in with a seatbelt), will always return to the upright position; which is ideal for a handicapped operator.

In an example, the seated flotation device has the steering control joystick between the legs of the operator. As a safety feature, the joystick can have a release joint at its base that allows the joystick to fold forward 90 degrees into a pocket in the flotation device, flush out of the way. In the advent of an accident where the operator slid forward, the joystick would snap forward at the release joint, and fold out of the way of the operator.

In an example, the hydrofoil device, either full size or as a scale model, can operate (unmanned) by remote (radio) control. The flotation device can have a longitudinal round top, so that the hydrofoil will always return upright, if it flips over during operation. A remote control receiver antenna can protrude out of the top of the flotation device, for better reception during long distance operation. An optional FPV (First Person View) camera can be mounted on the front of the flotation device. An optional third vertical control fin above the fuselage (like a rudder), can be added so that tighter turns can be achieved. Remote control can be performed using a standard multichannel radio control model transmitter.

In one embodiment, the FPV can use a "Head Tracking" Camera. Here, the watercraft would include a camera mounted on a miniature Pan & Tilt servo system; and the FPV Goggles can be worn by a user on the head and use the motion of the head turning and/or rotating, to point the camera left/right and up/down to look through the camera. In other words, a user would have the ability to look around the watercraft. In some embodiments, the watercraft includes a Spherical Cockpit Dome, so the camera inside has the ability to Pan & Tilt within it.

In an example, the hydrofoil device operates as an unmanned drone, without the flotation device; which allows it to operate a camera either submerged or above the water.

In an example, a distance to water sensor (height above water) can be added for maintaining the height above the water.

In an example, a GYRO can be added to limit the amount that the hydrofoil device can bank/roll left or right, and to limit the amount that it can pitch forwards or backwards.

A steering system for a hydrofoil watercraft, wherein a user may ride in a seated, prone, kneeling, or standing position while steering the watercraft without the use of his or her bodyweight. Vertical elevation, left and right roll, and longitudinal direction control of the watercraft is accomplished via steering, resulting in movement of the control surfaces (fins) on the hydrofoil, thus eliminating the need for weight shifting on the flotation device. An electronic remote and/or mounted joystick steering system can be operated either electronically or through direct mechanical linkage to control the direction of the watercraft. The steering system can include an unmanned remote controlled drone hydrofoil watercraft that can be operated remotely.

In an example, push-pull cables are used to operate the movable small fins. Alternate means for driving the small fins include push rods, control arms, and gear drives.

BRIEF DESCRIPTION OF THE DRAWINGS

FIGS. 6A-6C illustrate an alternative compact seated flotation device, which provides a safety feature of a collapsible joystick, which will fold forward down flush into the flotation device in the advent of an accident where the operator slides forward.

FIGS. 7A-7B illustrate another embodiments of an unmanned remote controlled hydrofoil drone (full size or scale model) with a foil wing and moveable surfaces (fins) for steering and an FPV for head tracking.

FIGS. 9A-9E illustrate a handheld remote control, which includes a trigger speed control, and a moveable joystick for steering control, display, and buttons to control the display, to adjust trim (neutral position) of the steering fins, and cruise control.

FIGS. 11A-11E illustrate the folding joystick mechanism, for safety.

FIGS. 12A-12C illustrate electronic servos (or other motorized device) which drive the push-pull cable mechanisms, for moving the steering fins.

FIGS. 15A-15F illustrate optional methods for driving the moveable steering fins, which includes alternate servo locations, gear drives, and use of push rods.

The same elements or parts throughout the figures of the drawings are designated by the same reference characters, while equivalent elements bear a prime designation.

DETAILED DESCRIPTION

Figure 1:
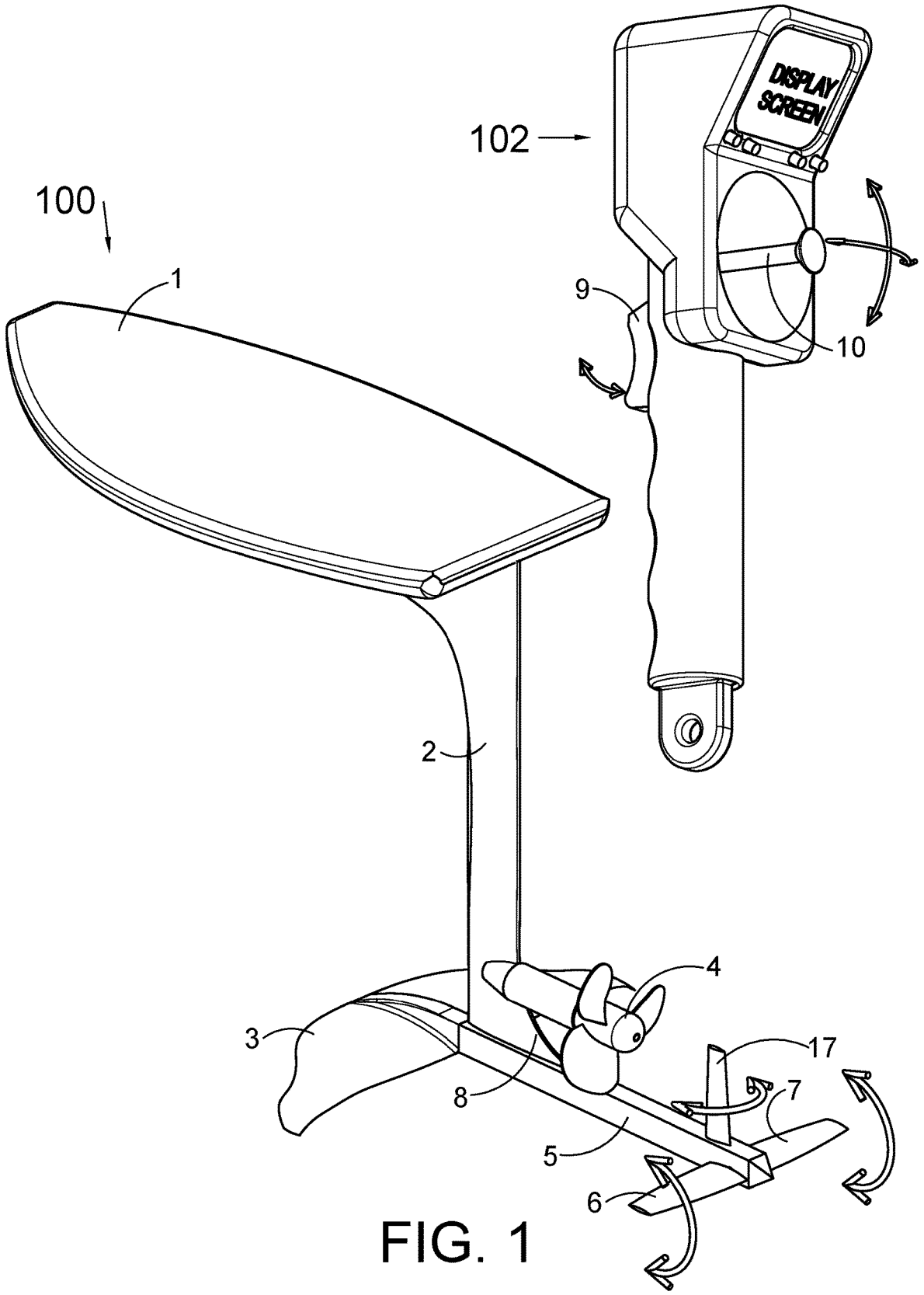
FIGS. 1A-1B illustrate a hydrofoil with movable steering fins, and a hand held remote control which includes a trigger (index finger controlled) speed control and a joystick (thumb controlled) for steering control; all operated with one hand, in the present invention.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale and are not intended to correspond to actual relative dimensions.

The detailed descriptions set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in practice or testing of the invention, the exemplary methods, devices and materials are now described.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

In one aspect, as shown in FIGS. 1A-1B, a perspective view of a hydrofoil watercraft 100 in accordance with an embodiment of the present invention is shown. Watercraft 100 may include a flotation device 1, a downward mast 2 connecting the fuselage 5 to the flotation device 1, a propulsion system 4, a foil wing 3 for lift, and a left steering fin 6 and right steering fin 7, for left and right roll, and up and down control. The watercraft 100 can include a third vertical steering fin 17 above the fuselage. In a simplified embodiment, the hydrofoil device steering could operate just the single vertical steering fin 17 to control left and right roll, with the left fin 6 and right fin 7 fixed; requiring the operator to use limited weight shifting (front to back) to control the pitch. The mast base radius 8 connected to the fuselage 5 provides a smooth 90 degree bend for the push-pull cables 43 and 44 (of FIGS. 12A-12C) enclosed within, that operate the left and right steering fins 6 and 7 respectively. The primary function of the flotation device 1 is to provide flotation at low speeds, and in this embodiment the top surface of the flotation device 1 is flat to allow an adult human to lie prone, sit, kneel, or stand on it. Further, in the present embodiment, the left and right steering fins 6, 7 are rotated along two axes that are symmetrical with respect to the fuselage. However, in different embodiments, the left and right steering fins 6, 7 can be rotated along a common axis. In yet another embodiment, the left and right steering fins 6, 7 can be rotated along different axes that substantially co-planar.

In this embodiment, a handheld remote 102 is used for control of speed and steering, and can be held and operated with a single hand. The trigger for speed 9 control is operated with the index finger. The joystick 12 is operated with the thumb.

FIGS. 2A-2F show various configurations that the foil wing 3, propulsion system 4, fuselage 5, left steering fin 6, and right steering fin 7, vertical steering fin 17 may be rearranged and/or configured. However, not all contemplated embodiments are illustrated in the figures.

Figure 2A:
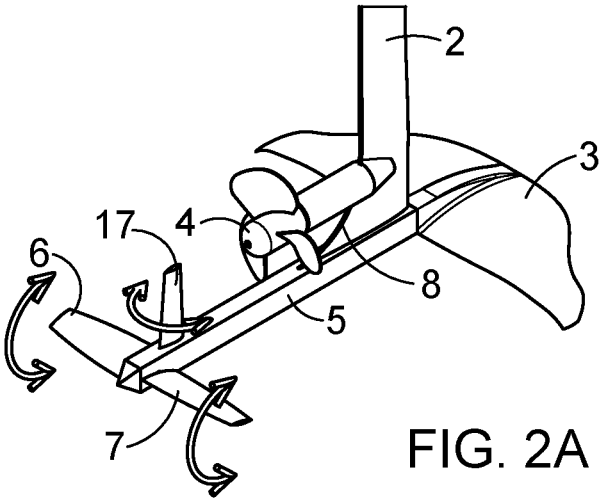
FIGS. 2A-2F illustrate multiple hydrofoil configurations (without the flotation device), each which include a hydrofoil, and movable surfaces (fins) for steering.

FIG. 2A illustrates an embodiment where the left steering fin 6 and right steering fin 7 extend in opposite directions and generally perpendicular to the length of the fuselage 5. The left steering fin 6 and right steering fin 7 can be moved independently relative to each other. The vertical steering fin 17 can extend vertically from the fuselage 5, wherein the vertical steering fin 17 can move independently from the left steering fin 6 and the right steering fin 7, wherein the vertical steering fin 17 can generally be perpendicular to the plane of the left steering fin 6 and the right steering fin 7. In an example, the left steering fin 6 and the right steering fin 7, wherein the vertical steering fin 17 can each be a single rotational fin.

Figure 2B:
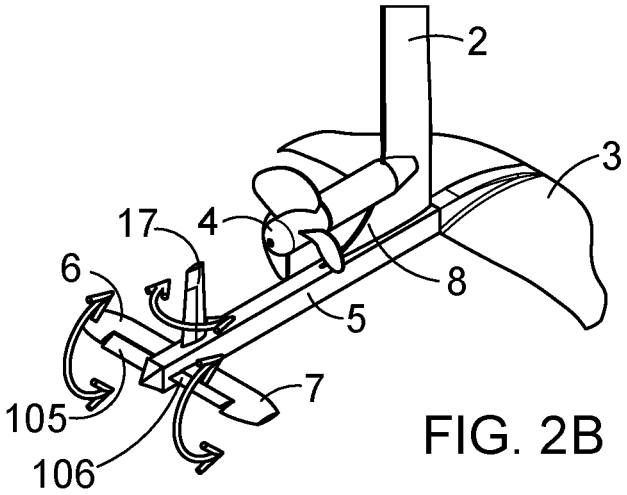

The embodiment illustrated in FIG. 2B is similar to the embodiment of FIG. 2A, but the embodiment in FIG. 2B has a portion of the steering fins 6 and 7 are fixed, and a portion is moveable. In other words, the steering fins 6 and 7 can include independently movable flaps 105, 106. This alternative steering fin embodiment, with fixed and moveable flaps 105, 106 of the steering fin, should be considered as an alternative substitute for all configurations shown, in which the entire fin is being rotated.

Figure 2C:
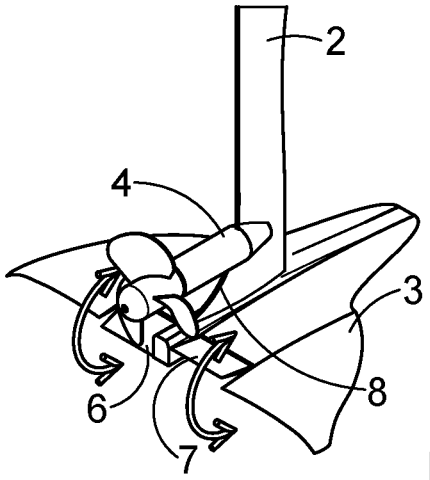

The embodiment illustrated in FIG. 2C has a single elongated foil wing 3, eliminating the fuselage 5. Both the left and right steering fins 6 and 7 respectively are attached to the rear of the large foil wing 3.

Figure 2D:
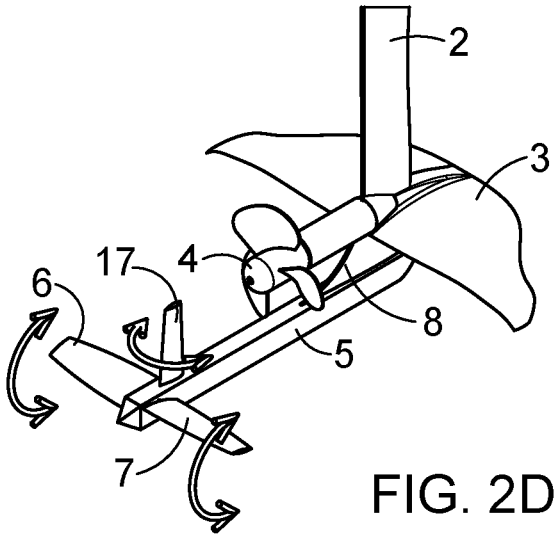

The embodiment illustrated in FIG. 2D has the foil wing 3 and propulsion system 4 lined up longitudinally together on the mast 2, with the left and right steering fins 6 and 7 respectively, attached to the rear of the fuselage 5, which is mounted at the base of the mast 2. In an example, the foil wing 3 is fixed. In an example, the foil wing 3 can be moved independent relative to each other, and independent relative to the left steering fin 6 and right steering fin 7.

Figure 2E:
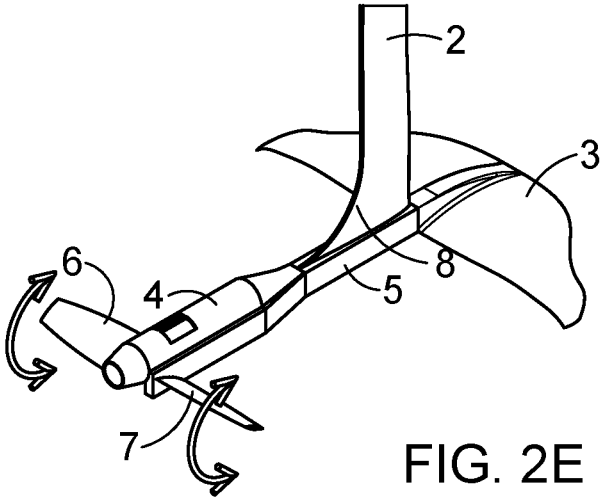

The embodiment illustrated in FIG. 2E has the foil wing 3, fuselage 5, and propulsion system 4 all aligned along a horizontally. The propulsion system 4 can be a pump with an enclosed impeller. The fuselage 5 can be split in half and follows along the outside of the propulsion system 4. The left and right steering fins 6 and 7 respectively, are shown each attached to the rear half of the split fuselage 5.

Figure 2F:
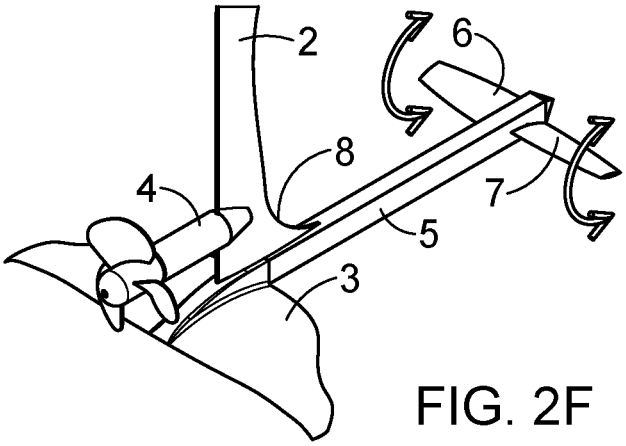

The embodiment illustrated in FIG. 2F has the foil wing 3 in the rear, and the left and right steering fins 6 and 7 respectively, in the front of the fuselage 5. The mast 2 has the mast base radius 8 going forward, to accommodate the push-pull cables 43 and 44 (shown in FIGS. 12A-12C) inside.

In one embodiment, the hydrofoil watercraft has a foil wing attached to a portion of a front end of the fuselage and the downward mast, and wherein the movable fins are attached to a portion of a rear end of the fuselage. Here, the wing can be also either attached to the fuselage or the mast. FIG. 2D shows the fin attached to the mast and the fuselage is further down.) In other embodiments such as FIG. 2C, the fuselage is integrated with the wing.

Figure 3:
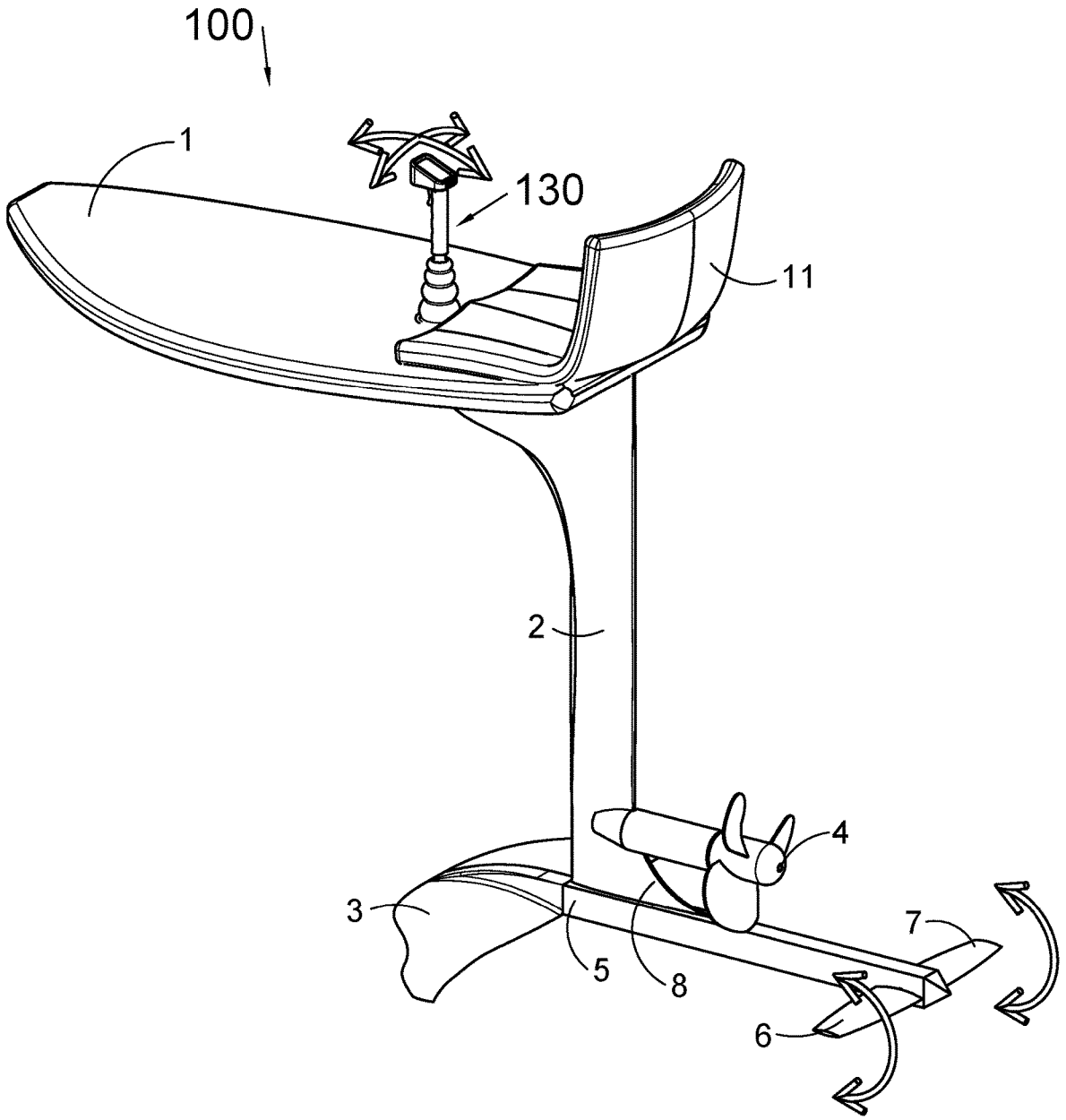
FIG. 3 illustrates a view of an electric hydrofoil surfboard which includes a hydrofoil and movable surfaces (fins) for steering; a seat, and a joystick control mounted to the surfboard, which includes a trigger speed control, and a moveable joystick for steering control.

In an embodiment illustrated in FIG. 3, the hydrofoil watercraft 1A includes a seat 11 and mounted joystick 12 in communication with a controller.

FIGS. 4A-4D illustrates the various steering control movements (left, right, forward, and back) of the mounted joystick controller 12, and the resulting movement of the left steering fin 6 and the right steering fin 7.

Figure 4A:
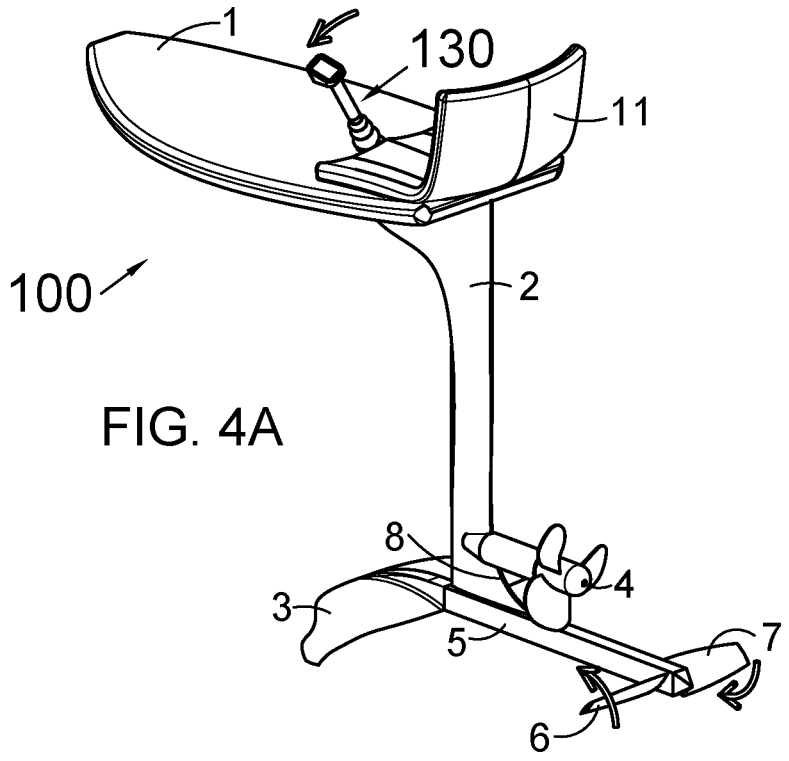
FIGS. 4A-4D illustrate the joystick movements (left, right, down, and up), and the resulting control surface (fin) movements for steering.

The hydrofoil watercraft in the embodiment illustrated in FIG. 4A shows the mounted joystick 12 tilted to the left, resulting in the leading edge of the left steering fin 6 rotated down, and the leading edge of the right steering fin 7 rotated up. The effect of this steering fin movement, is to rotate the hydrofoil watercraft left along the longitudinal axis, or counterclockwise when viewed from the rear.

Figure 4B:
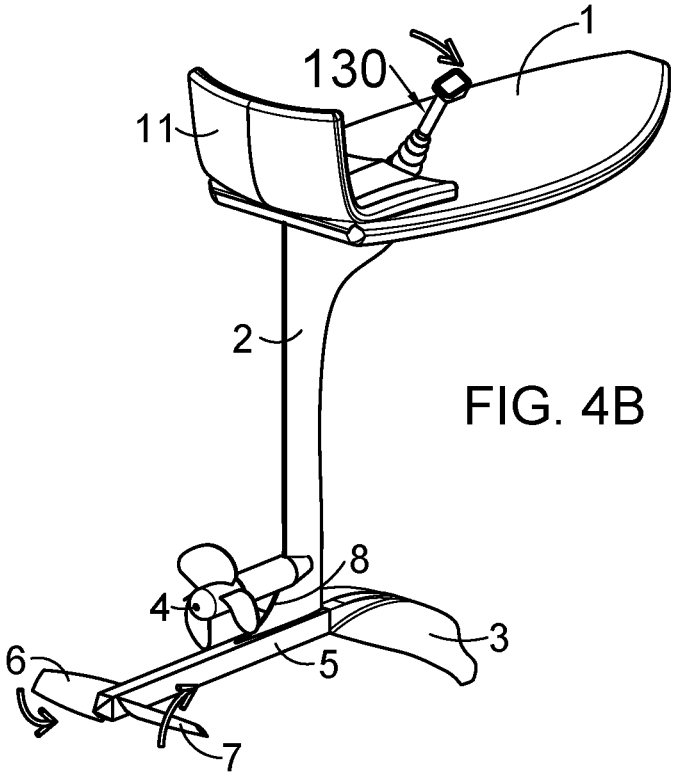

The hydrofoil watercraft embodiment illustrated in FIG. 4B shows the mounted joystick 12 tilted to the right, resulting in the leading edge of the left steering fin 6 rotated up, and the leading edge of the right steering fin 7 rotated down. The effect of this steering fin movement, is to rotate the hydrofoil watercraft right along the longitudinal axis, or clockwise when viewed from the rear.

The hydrofoil watercraft 4C shows the mounted joystick 12 tilted forward, resulting in the leading edge of both the left steering fin 6 and right steering fin 7 rotated up. The effect of this steering fin movement, is to tilt the hydrofoil watercraft nose down, or force the hydrofoil watercraft down deeper into the water.

The hydrofoil watercraft 4D shows the mounted joystick 12 tilted back, resulting in the leading edge of both the left steering fin 6 and right steering fin 7 rotated down. The effect of this steering fin movement, is to tilt the hydrofoil watercraft nose up, or lift the hydrofoil watercraft up in the water.

Turning movements are accomplished by either rotating left or right, then pulling the mounted joystick 12 back. The movement of the joystick 12 is communicated to controller for actuating the position of the left steering fin 6, right steering fin 7, and the vertical fin 17.

An embodiment illustrated in FIGS. 5A-5B includes a seated hydrofoil watercraft 100, and is similar to the hydrofoil watercraft in FIG. 3, except that flotation device 1 is shaped like a small compact one person boat, where the operator is in the seated position, sunk down into the flotation device, resulting in improved stability in the water, due to the overall center of gravity being below the center of buoyancy. Thus, if the hydrofoil device turns over, and the operator remains seated and/or uses a seat belt, the hydrofoil device will automatically return upright in the water. The flotation device 1 also has a cutout on each side used as a leg rest 13, and a footrest 14, so that the operator may sit with his legs/feet hanging off on each side, or resting inside the flotation device on the footrest 14.

Figure 5A:
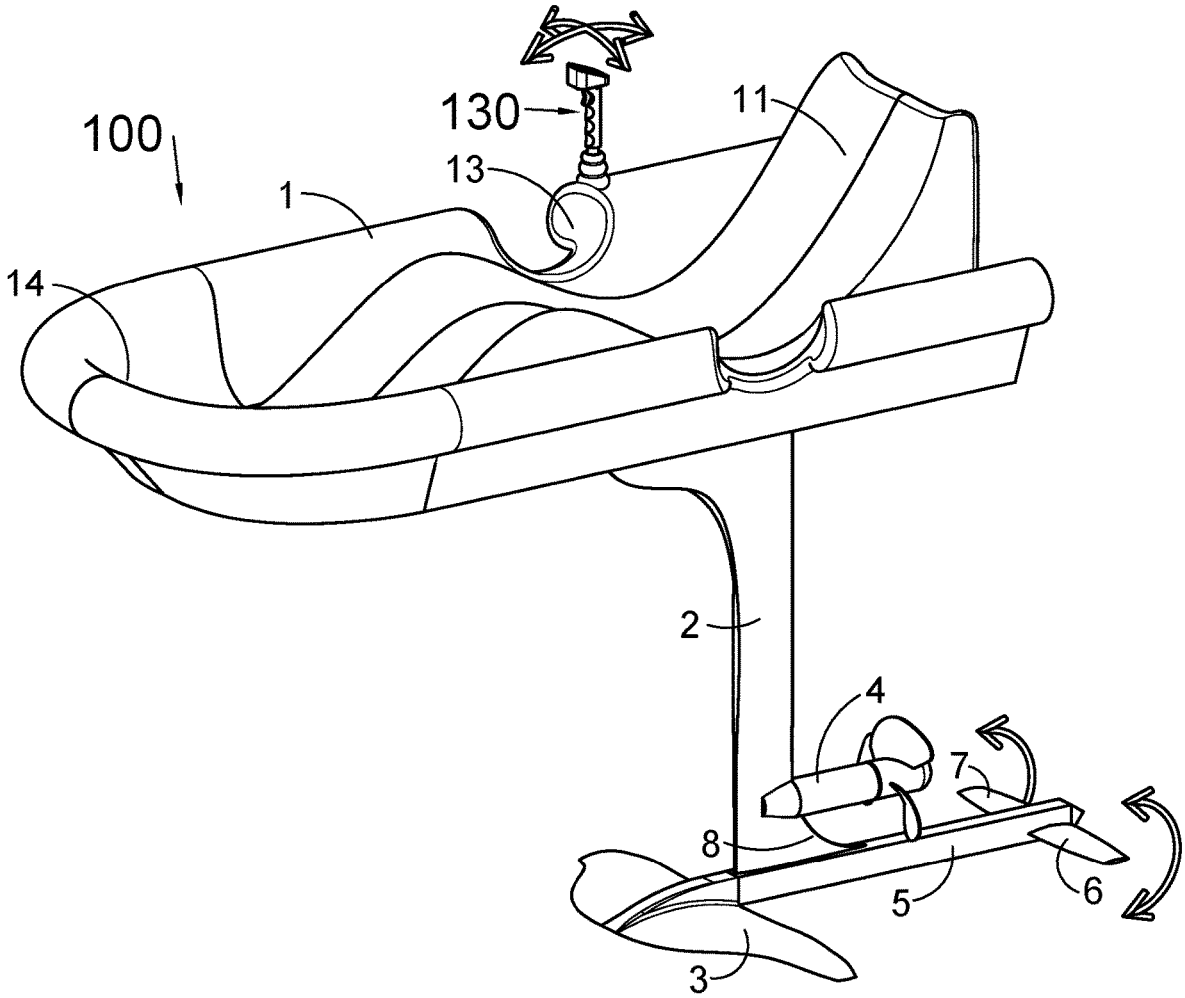
FIGS. 5A-5B illustrate an alternative seated flotation device, where the center of gravity is below the center of buoyance, so the operator (if using a seatbelt) and watercraft, will always return upright after a fall.
Figure 5B:
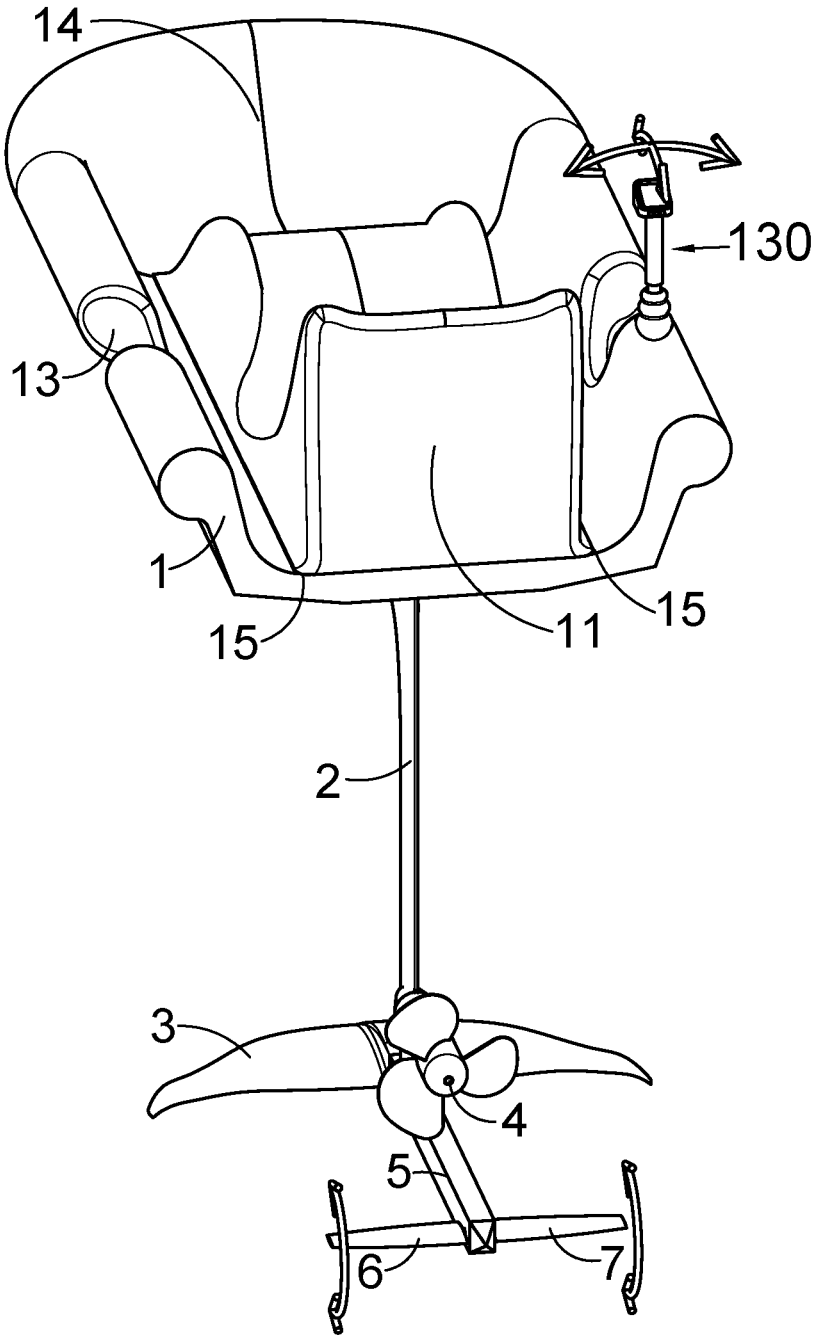

The hydrofoil watercraft 100 illustrated in FIGS. 5A and 5B has the mounted joystick 12 on the right side of the arm rest of the flotation device 1. In a rear view of the same hydrofoil watercraft 5B embodiment, the flotation device 1 has drain openings 15 to allow any water initially trapped in the flotation device 1 to immediately drain out on both sides of the drain openings 15, when the hydrofoil watercraft initially begins forward motion.

In one embodiments as shown in FIG. 5, the hydrofoil watercraft if tipped, would ride itself back into a floating position for added safety to a user. Controllers can be mechanical or electrical. In one preferred embodiment, the controllers are located in a side portion of the hydrofoil watercraft for ease of running push-pull cables.

Figure 6A:
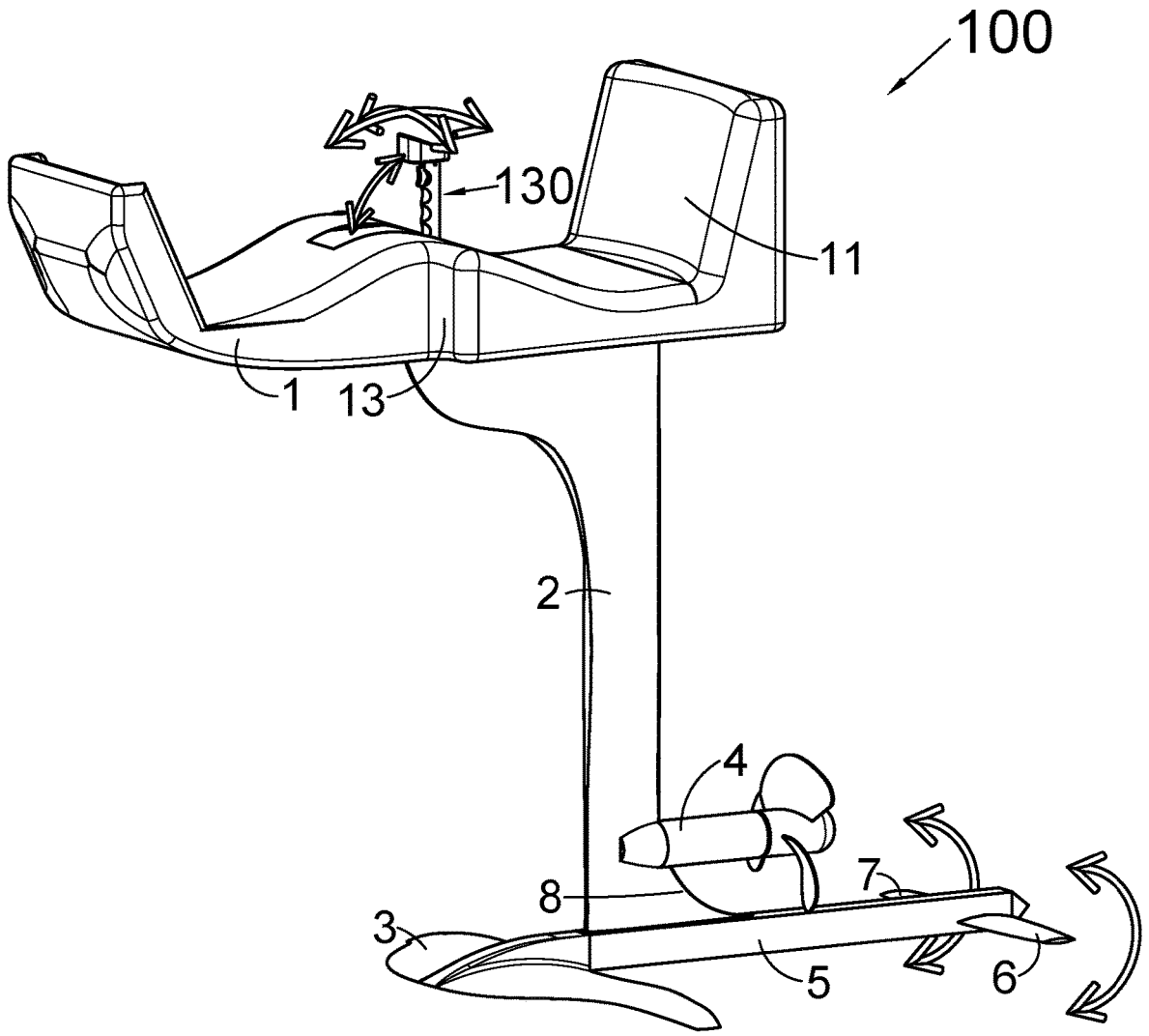
Figure 6B:
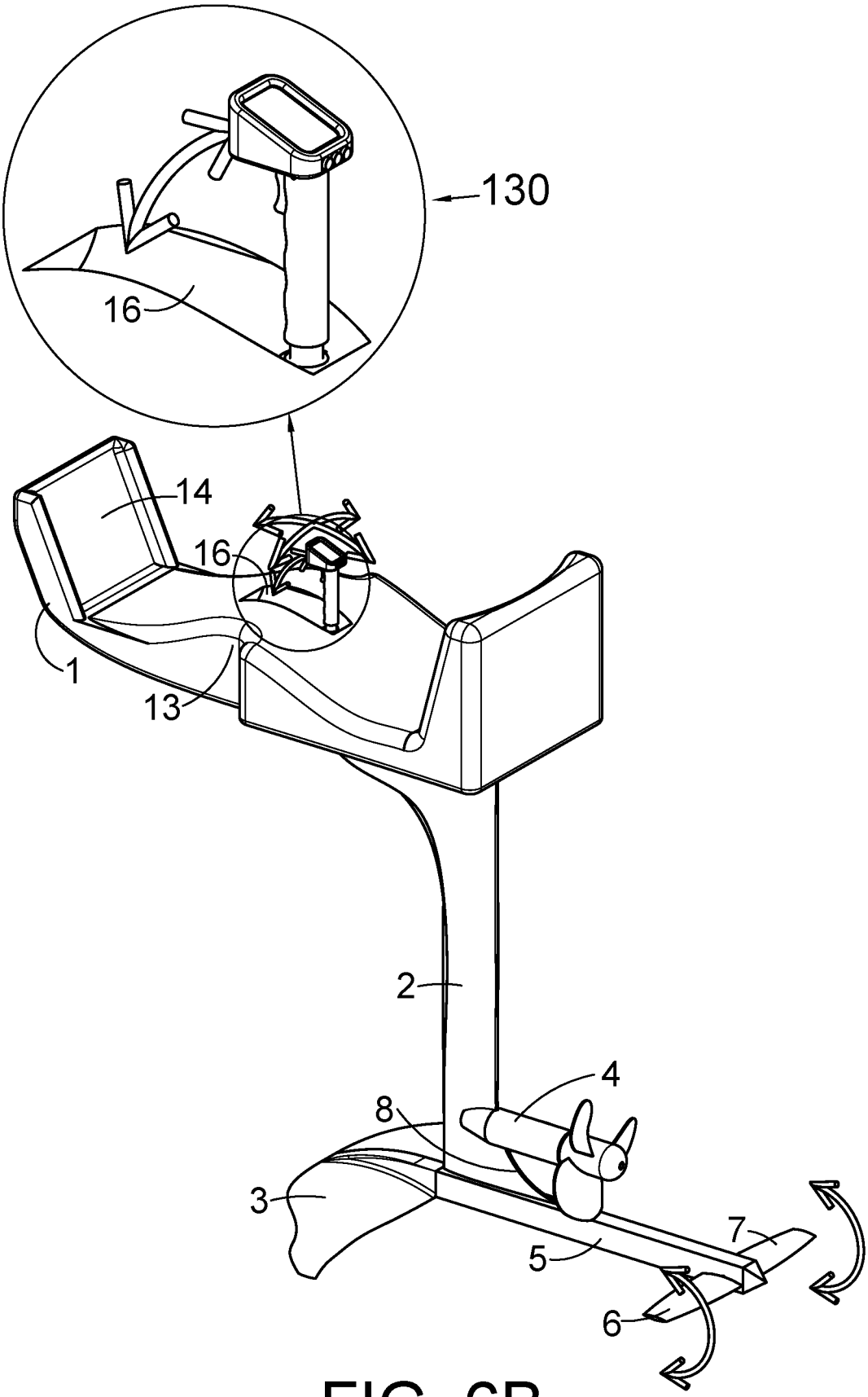

In an embodiment illustrated in FIGS. 6A-6B a seated hydrofoil watercraft 100 is shown, and is similar to the hydrofoil watercraft in FIG. 3, where the seated flotation device 1 has the mounted joystick controller 12 between the legs of the operator. As a safety feature, the mounted joystick controller 12 has a release joint at its base that allows the joystick to fold forward 90 degrees into a recessed pocket 16 shown in detail 6C in the flotation device 1, flush out of the way. In the advent of an accident where the operator slid forward, the joystick would snap forward at the release joint, and fold out of the way of the operator. The flotation device also has a cutout on each side as a leg rest 13 and a footrest 14, so that the operator may sit with his legs/feet hanging off on each side, or resting inside the flotation device on the footrest 14.

Figure 7A:
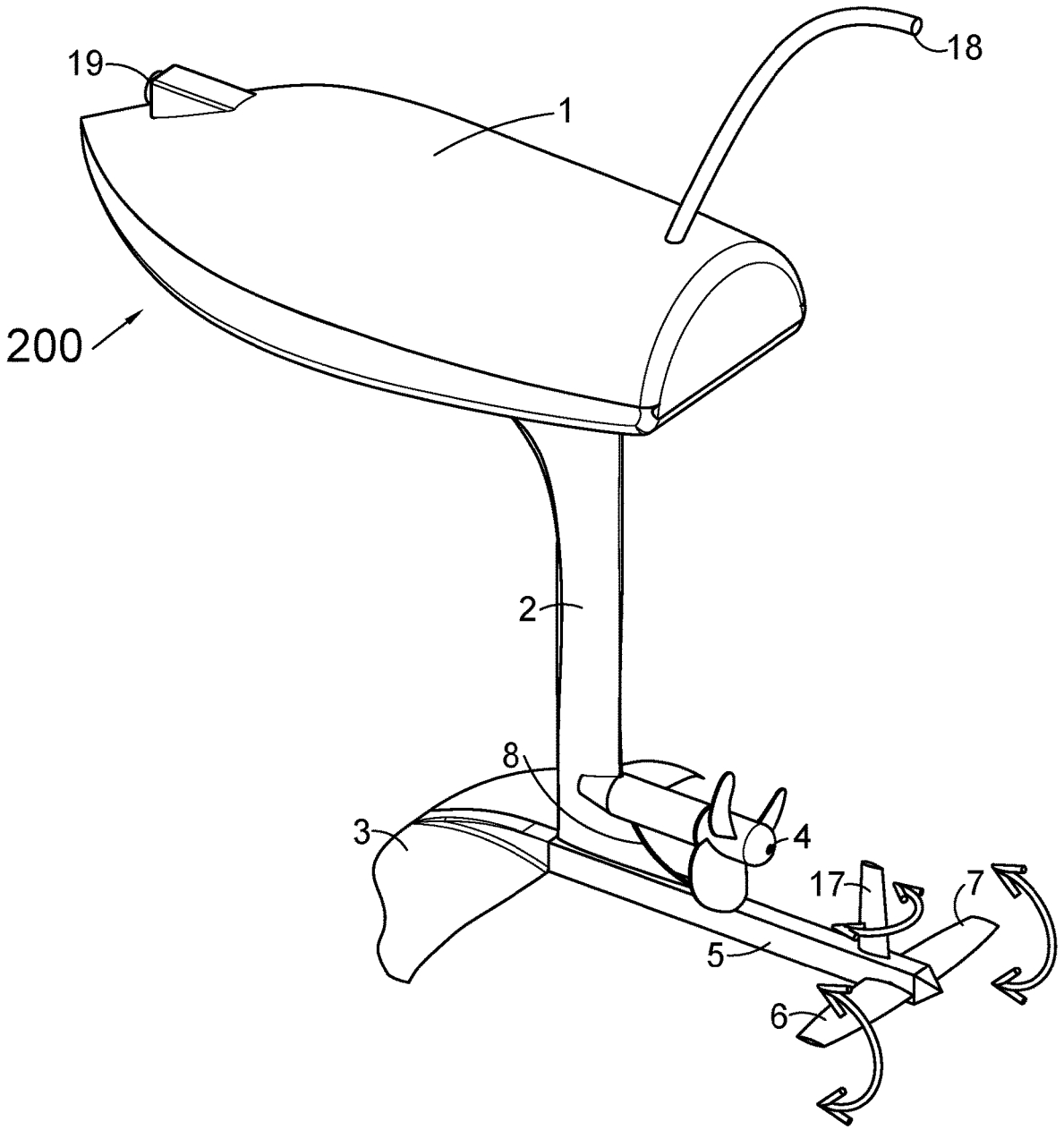
FIGS. 7A-7B illustrate an unmanned remote controlled hydrofoil drone (full size or scale model) with a foil wing and moveable surfaces (fins) for steering and an FPV for head tracking.
Figure 7B:
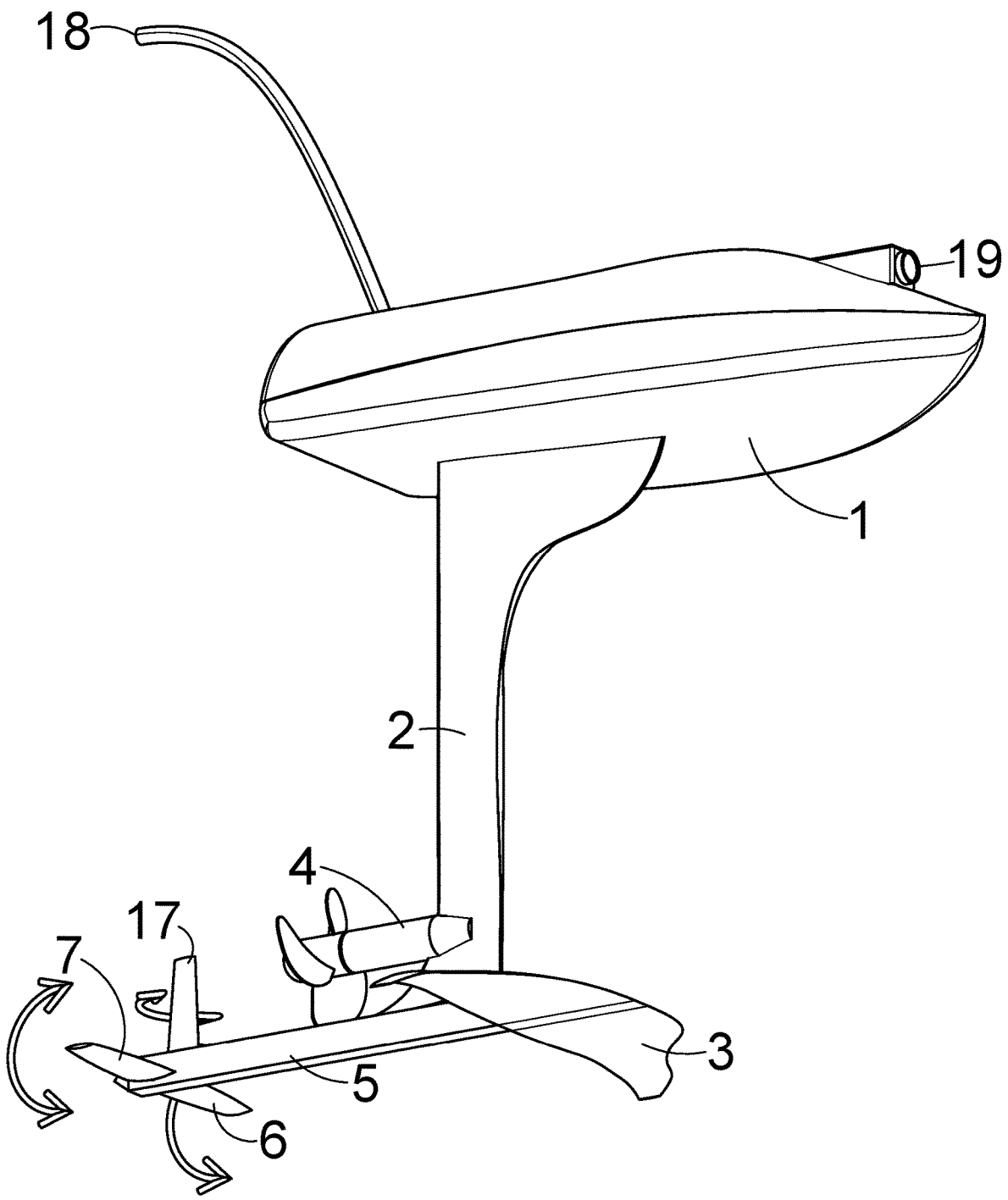
Figure 7C:
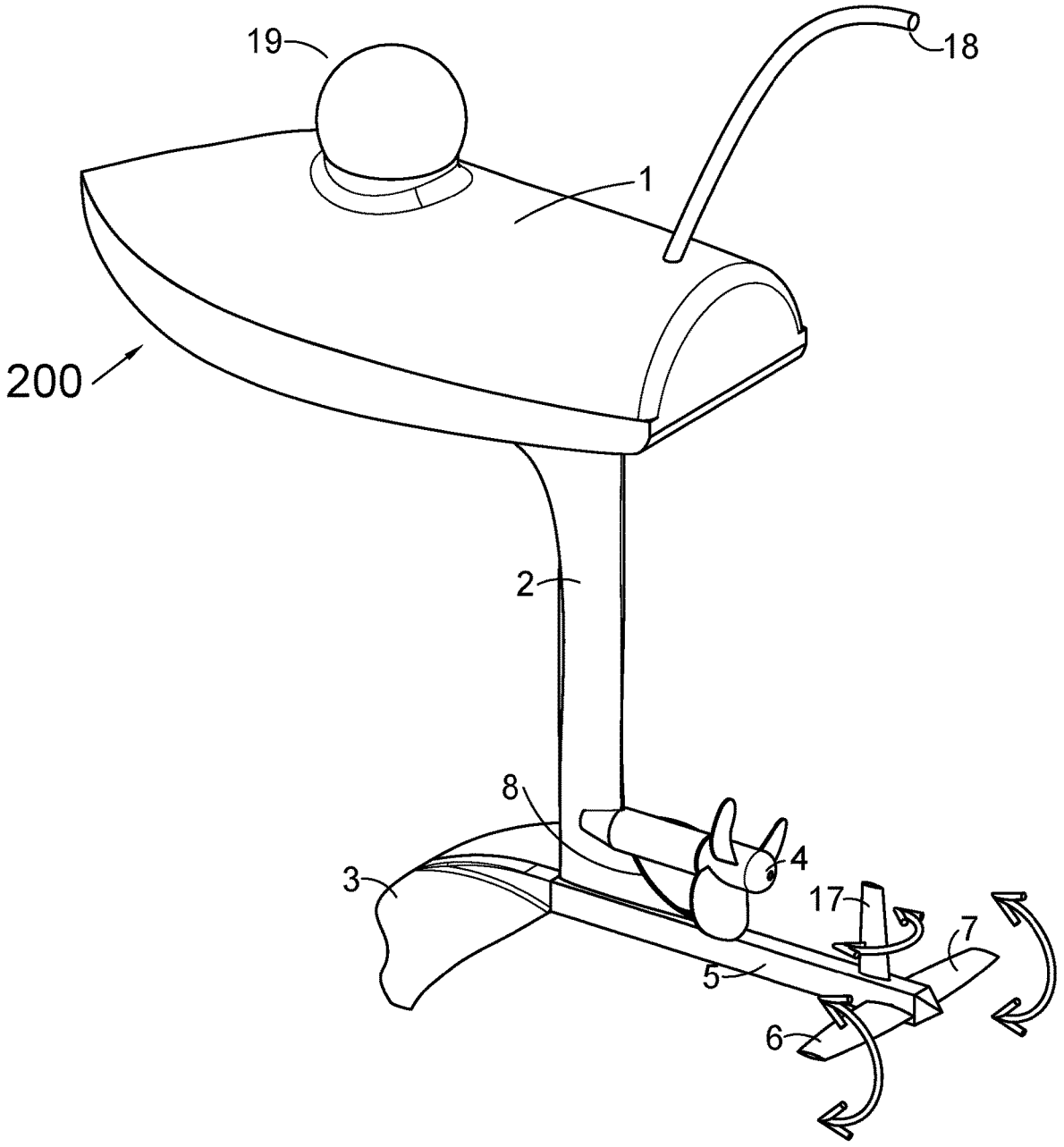
Figure 7D:
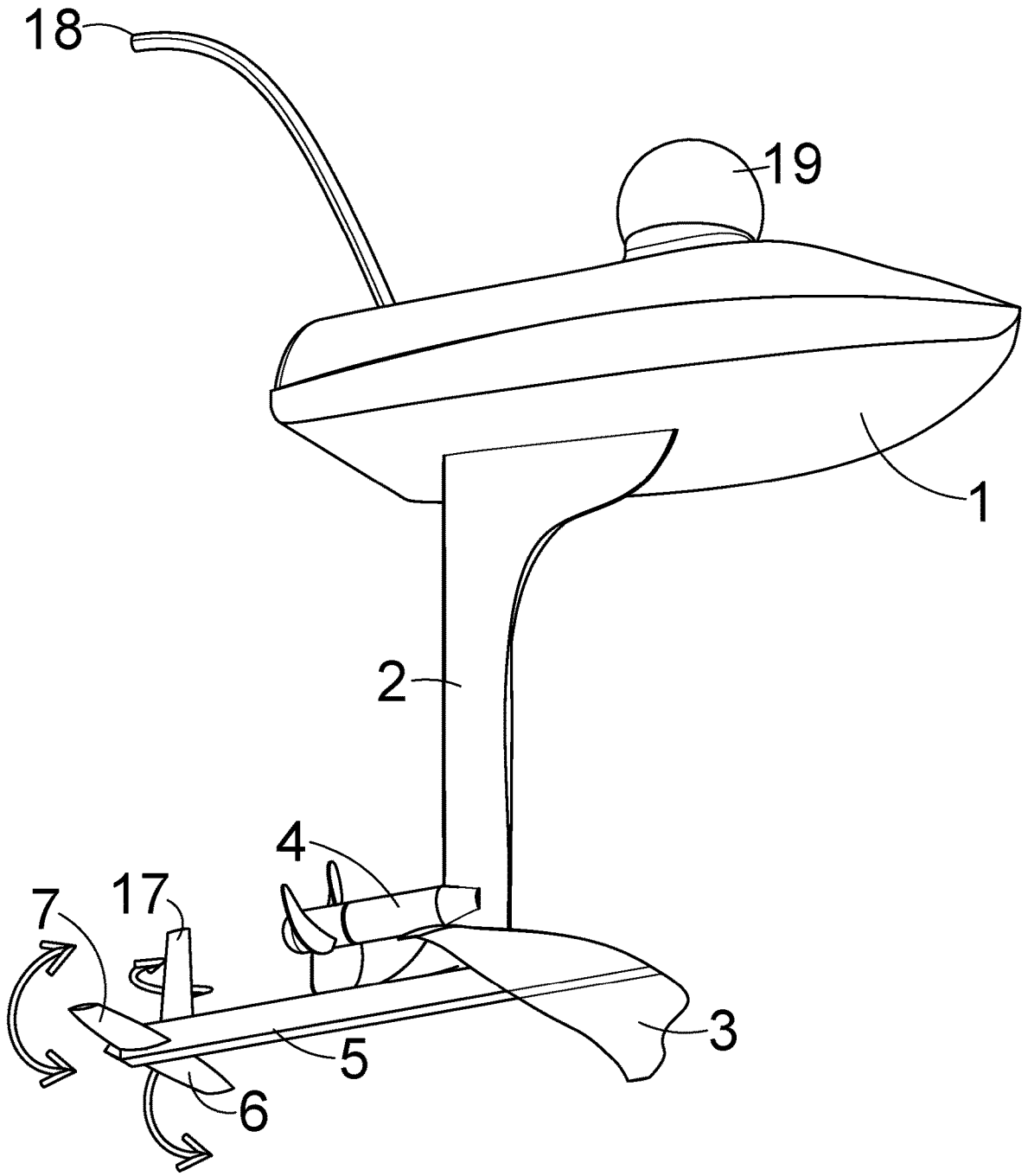

FIGS. 7A-7B shows an unmanned hydrofoil drone 200, which can be either full size or as a scale model, that operates by remote (radio) control. The flotation device 1 has a longitudinal round top, so that the hydrofoil will always return upright, if it flips over during operation. A remote control receiver antenna 18 protrudes out of the top of the flotation device 1, for better reception during long distance operation. On a top surface of the flotation device 1, a FPV (First Person View) camera 19 can be mounted for the remote operator to visualize as if they were sitting in the hydrofoil device. A third vertical steering fin 17 above the fuselage (like a rudder) can be added so that tighter turns can be achieved. Remote control can be performed using a standard multichannel radio control model transmitter.

Figure 8A:
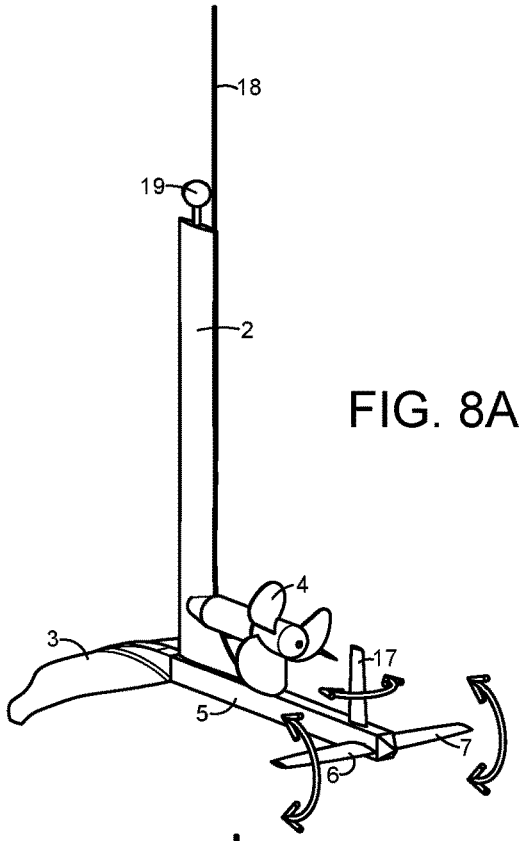
FIGS. 8A-8B illustrate an unmanned remote controlled hydrofoil drone (full size or scale model) designed to operate both above and below water, with a foil wing and moveable surfaces (fins) for steering.
Figure 8B:
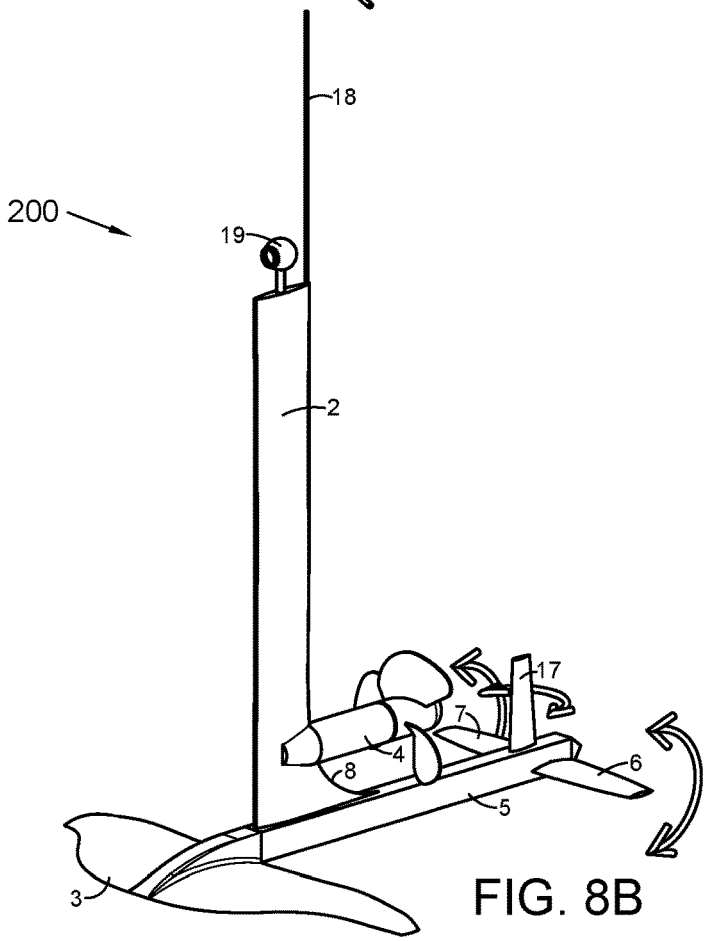

FIG. 8 shows an unmanned hydrofoil drone 200 without a flotation device at the top of the mast 2. Since the watercraft does not support an operator, flotation is accomplished with the volume displaced by the hollow mast 2 and fuselage 5. Further, the mast 2 may contain a ballast tank and pump to adjust the depth that the watercraft sits under water when resting. In an example, only the camera 19 and retractable antenna 18 need be resting just out of the water. Under power, the drone may operate autonomously fully submerged, or with the mast slightly out of the water. Additional sensors/instrumentation like sonar and a depth gauge, may be added to improve fully submerged operation. The camera may be mounted on a pan and tilt mechanism. In this configuration the drone can operate in a "stealth" mode at high speed, not easily spotted, since the narrow mast cuts through the water without creating a wake.

Figure 9A:
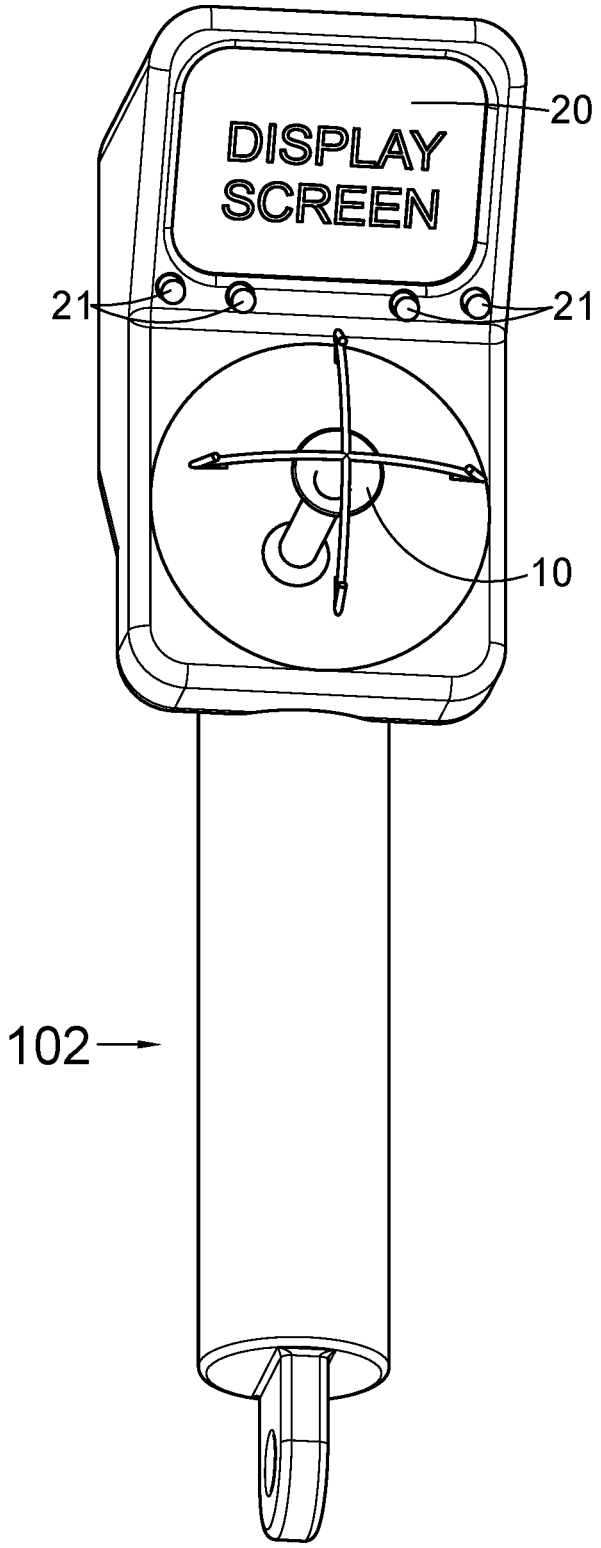
Figure 9B:
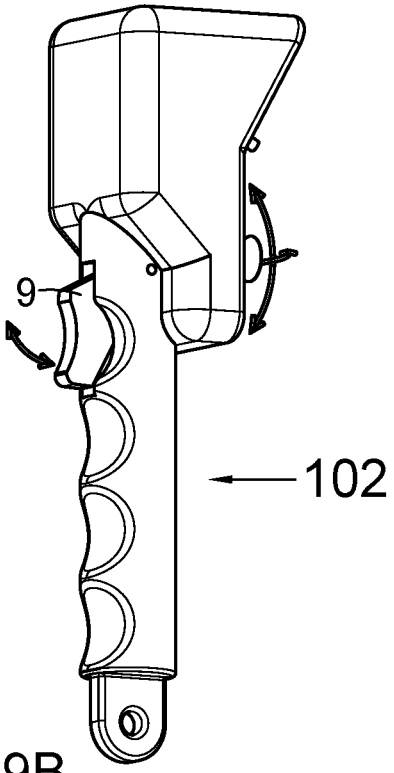
Figure 9C:
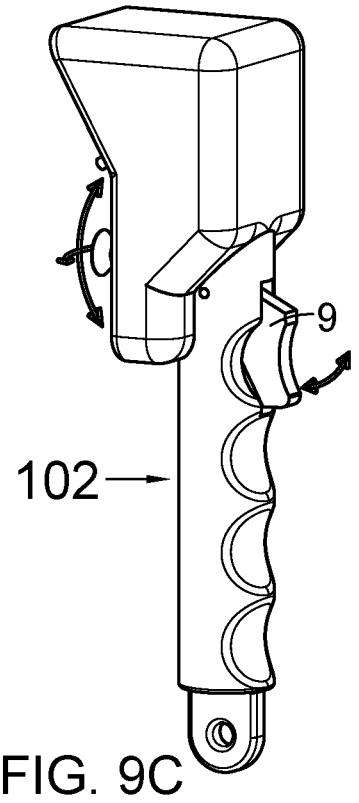

In FIG. 9 the handheld remote initially shown in FIG. 1B has additional views 9A, 9B, 9C, 9D, and 9E showing further details. The handheld remote 130 can be used for control of peed and steering, and can be held and operated with either the left or right hand. The hand held remote 130 has a proportional trigger for speed 9 control and is operated with the index finger, to control the propulsion system 4 speed. For steering, a two axis/channel joystick 12, similar to those used in radio control airplane transmitters is used, and operated with the thumb. The two axis/channel joystick 12, uses two position sensors (potentiometers/position encoders) for controlling the movement and position of the left and right steering fins 6 and 7 respectively, and can also control the vertical fin 17.

Figure 10A:
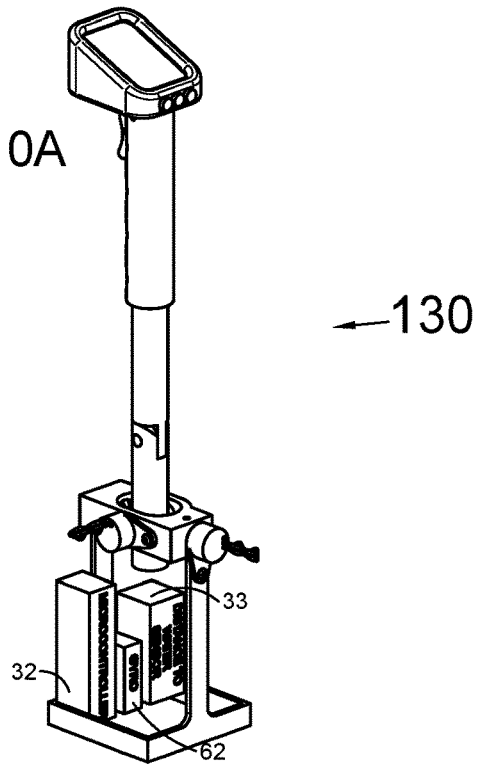
FIGS. 10A-10B illustrate a mounted joystick control, which includes a trigger speed control, and a moveable joystick for steering control with electronic position sensors (potentiometers/position encoders), a display; buttons to control the display, to adjust trim (neutral position) of the steering fins, and cruise control; a microcontroller; a an optional distance (to water) sensor for controlling the height of the flotation device out of the water; and a Gyro that limits roll and pitch.
Figure 10B:
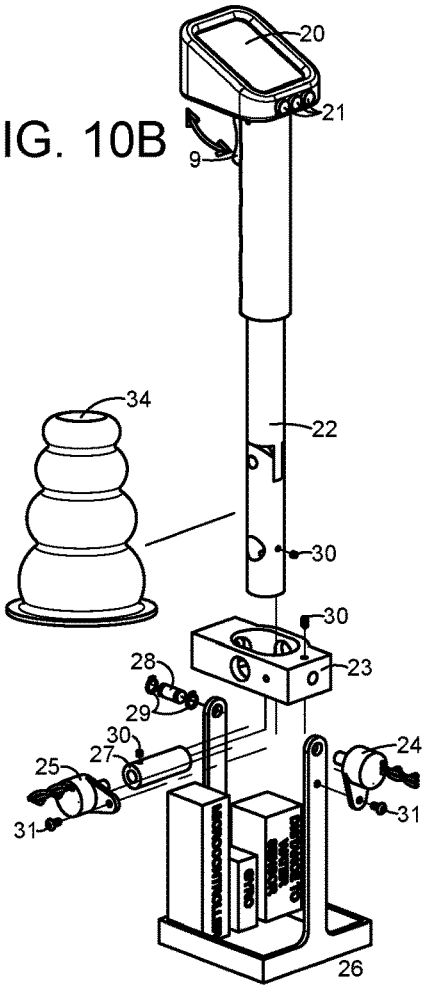

FIGS. 10A-10B illustrate an embodiment of a controller 32 that can be used to receive the two channel joystick position input, and transmit a signal to the servos 41 (shown in FIGS. 12A-12C) to drive the left and right steering fins 6 and 7 respectively. A display screen 20 is also included to provide information and operating parameters to the operator. Controller function buttons 21 are used to cycle through displays, for trim adjustment, and to set the cruise control speed. The handheld remote may have a wired connection to the hydrofoil watercraft or be wireless. A gyro 62 and distance to water sensor 33 provide the orientation (roll and pitch data) and height above the water data, respectively to the microcontroller 32.

Many of the parts for both the electronic (FIGS. 10A-10B) and mechanical (FIG. 13A-13E) versions of mounted joystick 12 can be the same. In one aspect, as shown in FIGS. 10A-10B, the mounted electronic joystick 12 that uses potentiometers 24 and 25 is shown fully assembled in detail in FIG. 10A, without the boot 34. In another aspect, as shown in FIGS. 13A-13E, the mounted mechanical joystick 12, that connects directly to the push-pull cables 44 and 45 is shown fully assembled in detail FIG. 13A, without the boot 34.

FIG. 10B shows an exploded view of electronic joystick 12, with a left-right roll potentiometer 24 and an up-down potentiometer 25, which work as position encoders. The mounting frame base 26 has two holes at the top, which allow the yoke 23 to rotate side to side, and actuate the input shaft of the left-right roll potentiometer 24 held in the yoke 23 with a set screw 30. The left-right roll potentiometer 24 body is mounted to the frame base 26 with screw 31. The other end of the yoke 23 is supported with left-right roll shaft 28. Left-right roll shaft 28 is held in place with two snap rings 29. The up-down potentiometer 25 body is mounted to the yoke 23 with screw 31, and the up-down potentiometer 25 input shaft is held inside the up-down shaft 27 with set screw 30. This up-down shaft 27 is centered in the yoke 23 and attached to the folding joystick assembly 22 with set screw 30. The boot 34 fits over the lower portion of folding joystick assemble 22. A controller 32 (e.g., microcontroller) is used to receive the two channel input from both potentiometers 24 and 25, the controller function button(s) 21, and the optional distance to water sensor 33, which then controls the servos 41 (shown in FIGS. 12A-12C), which in turn control the left and right steering fins 6 and 7, and the vertical fin 17.

Figure 11A:
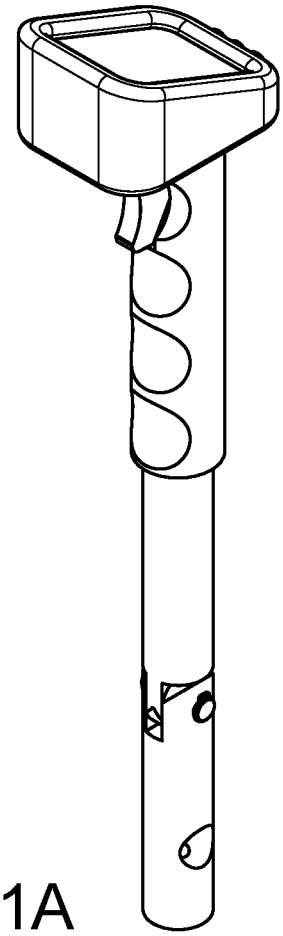
Figure 11B:
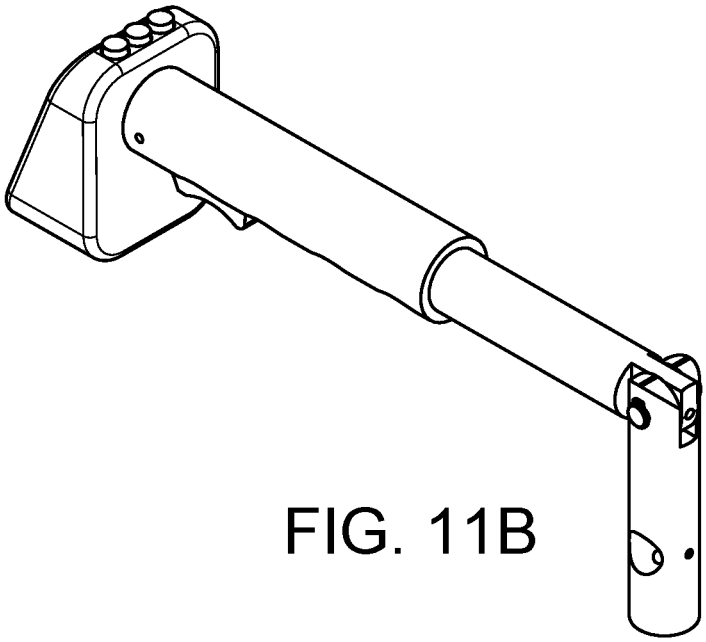
Figure 11C:
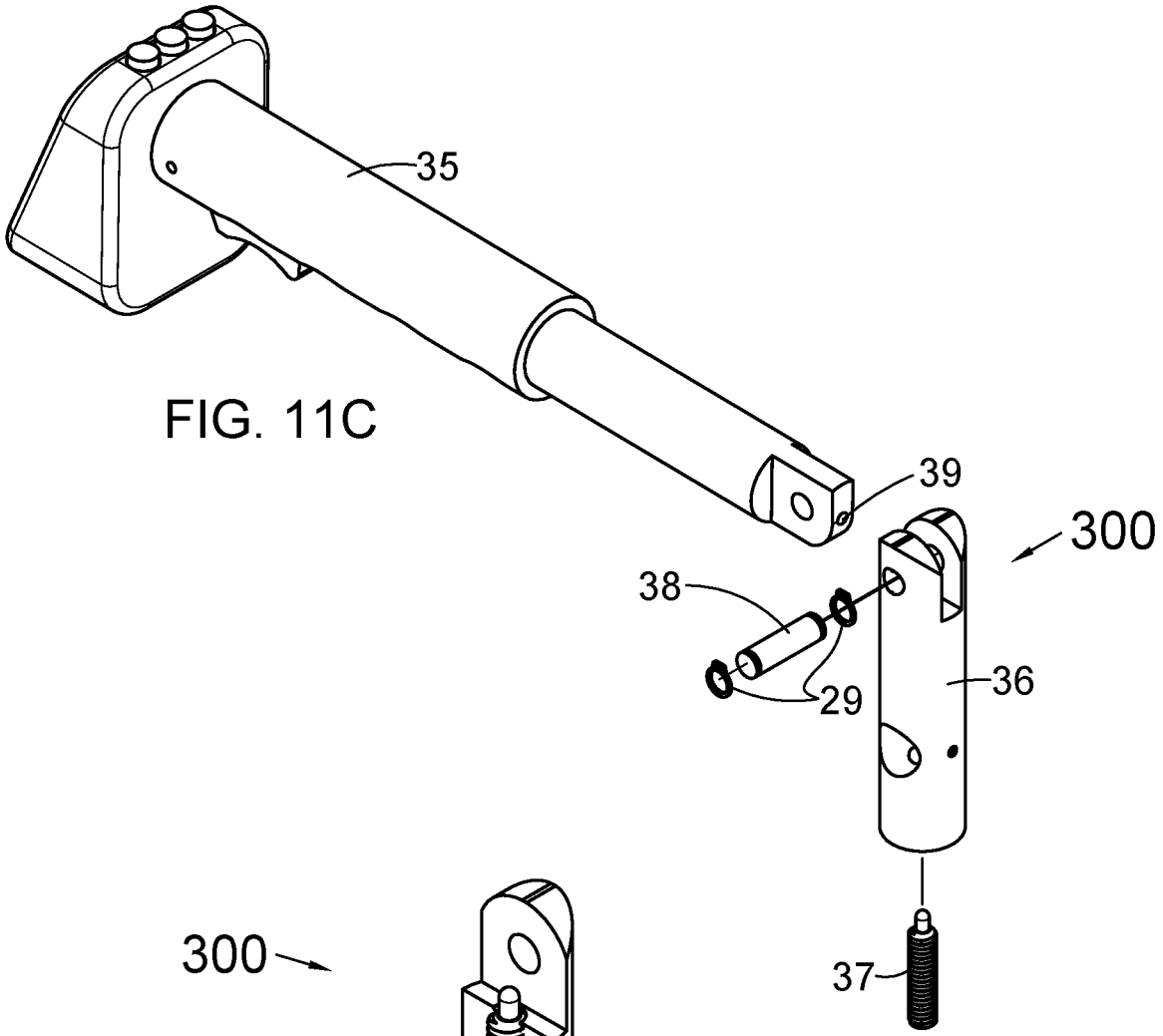
Figure 11D:
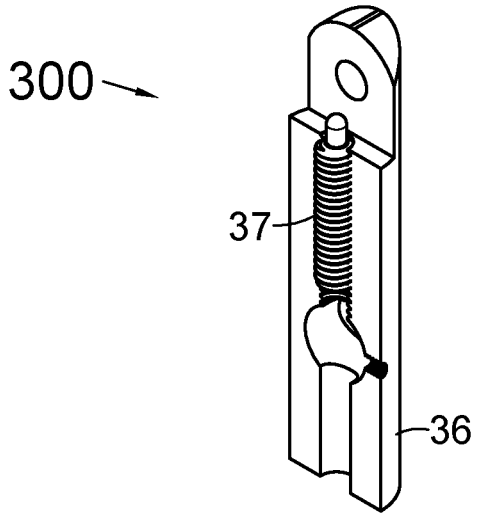

FIGS. 11A-11D show the folding joystick assembly 22. As shown in the sectional view in FIG. 11A, the lower joystick 36 has a long nose spring plunger 37 installed, which sets inside the detent recess 39 at the base of the upper joystick 35, when it's in the vertical position, as shown in FIGS. 11C and 11D. The upper joystick 35 in the vertical position will remain rigidly attached to the lower joystick 36, for left/right and back/forth motion, but will rotate forward 90 degrees as shown in FIGS. 11B and 11C, on folding joystick shaft 38 in the advent that the operator slides forward against the upper joystick 35. This safety feature in the event of an accident, where the operator slides forward, results in the long nose spring plunger 37 retracting from the detent recess 39, to allow the upper joystick 35 to rotate forward. The folding joystick shaft 38 is held in place with two snap rings 29.

Figure 12A:
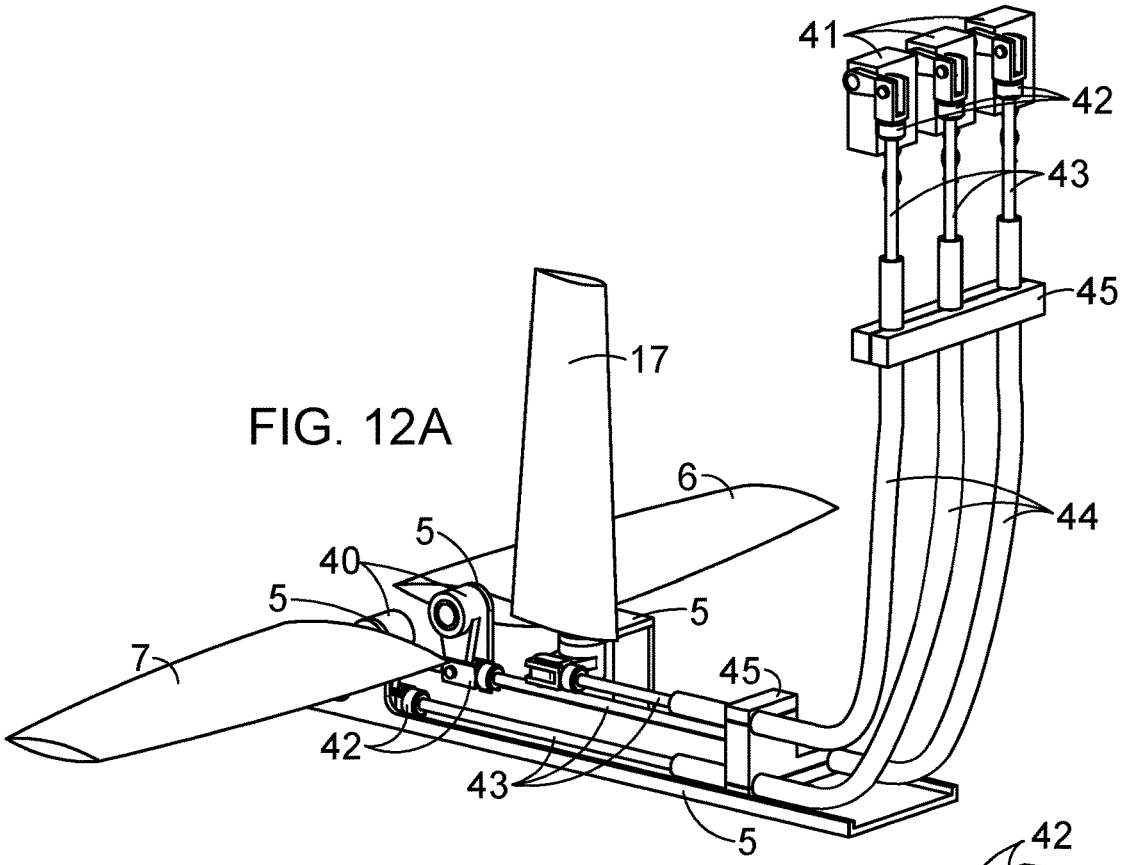
Figure 12B:
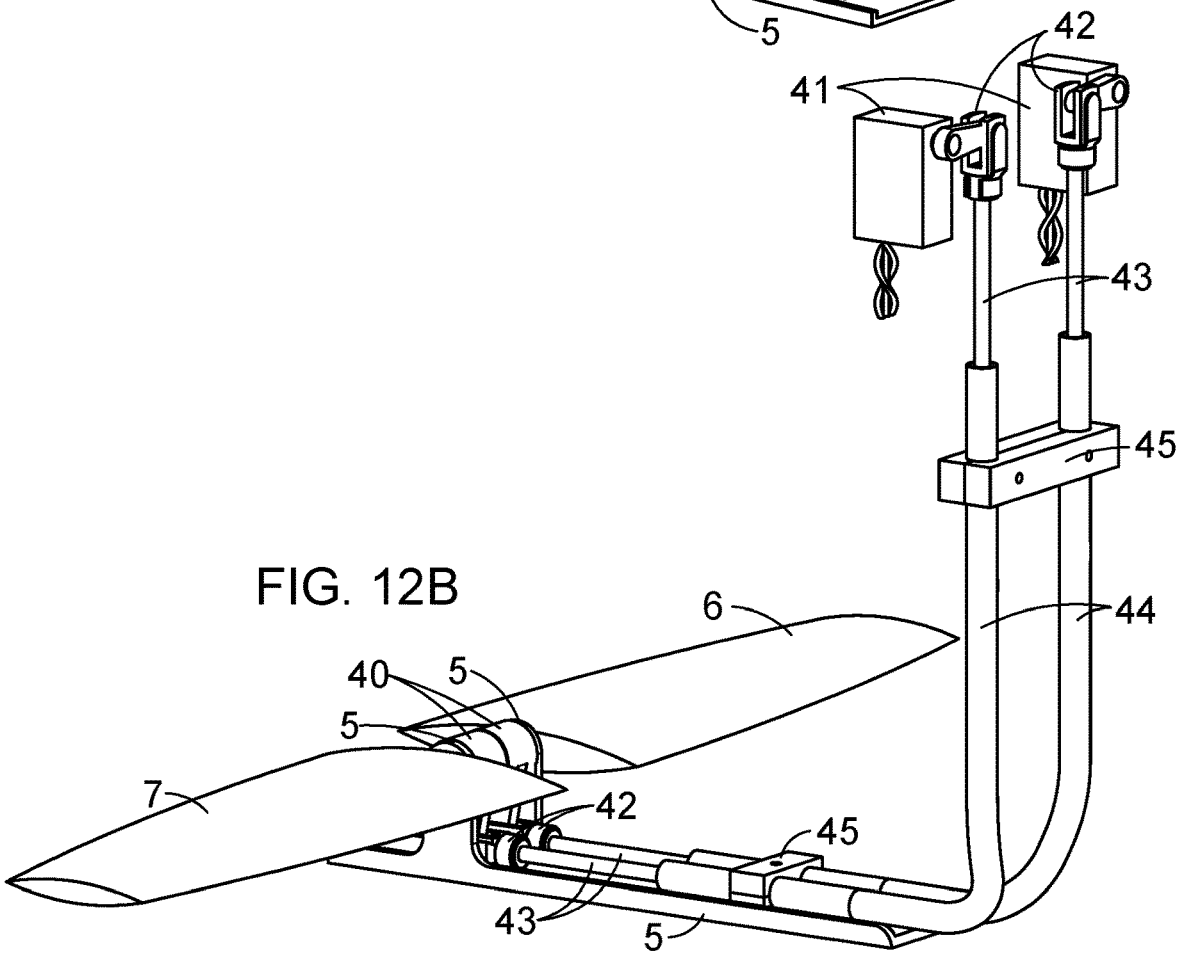

In another embodiment, FIGS. 12A and 12B show how the servos 41 operate the left and right steering fins 6 and 7 respectively, and vertical steering fin 17. The fuselage 5 is cut away except where the steering fins are held in place to allow rotational motion controlled by the control arms 40, which are attached to the shaft on each respective steering fin, through a hole in the fuselage 5. A push-pull cable system consisting of an outer casing 44 and a movable inner cable 43, is used for each servo 41 to control each steerable fin. A threaded clevis 42 is at each end of the inner cable 43. The push-pull outer casing 44 is held in place at each end with a clamp 45.

Figure 13A:
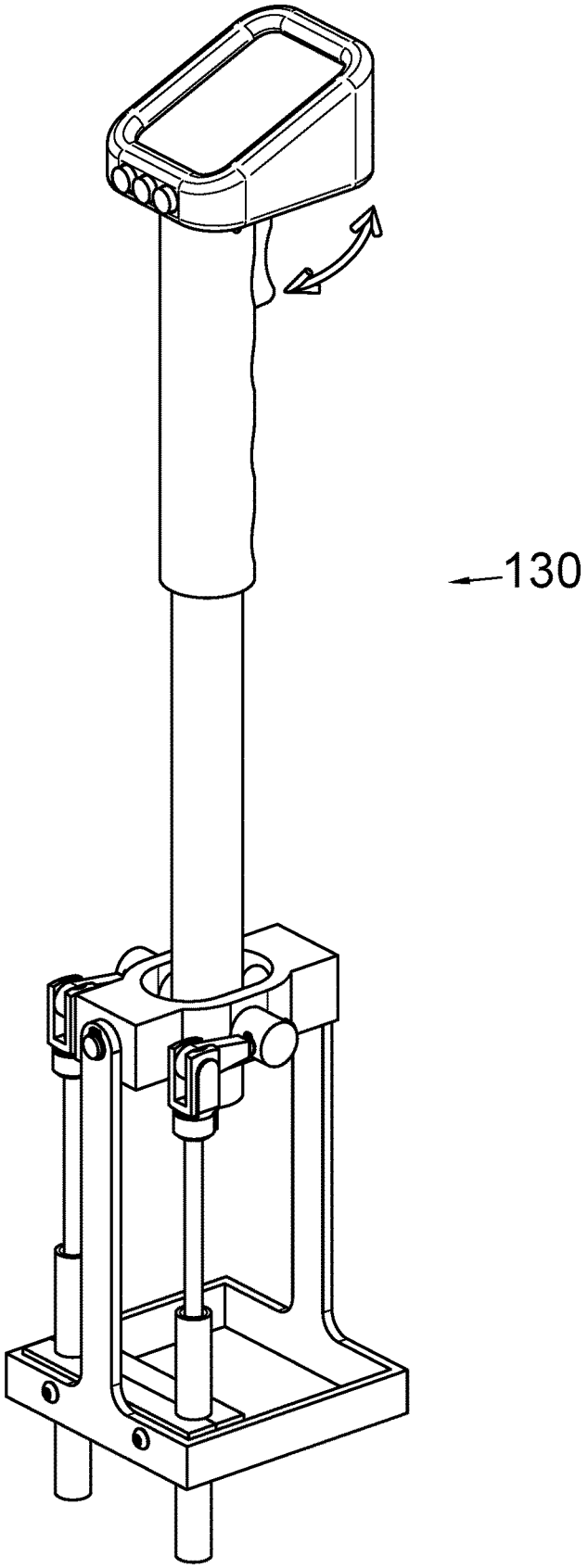
FIGS. 13A-13E illustrate a mounted joystick control, which includes a trigger speed control, and a moveable joystick for steering control, mechanically connected to the push-pull cable mechanisms, for moving the moveable steering fins.
Figure 13B:
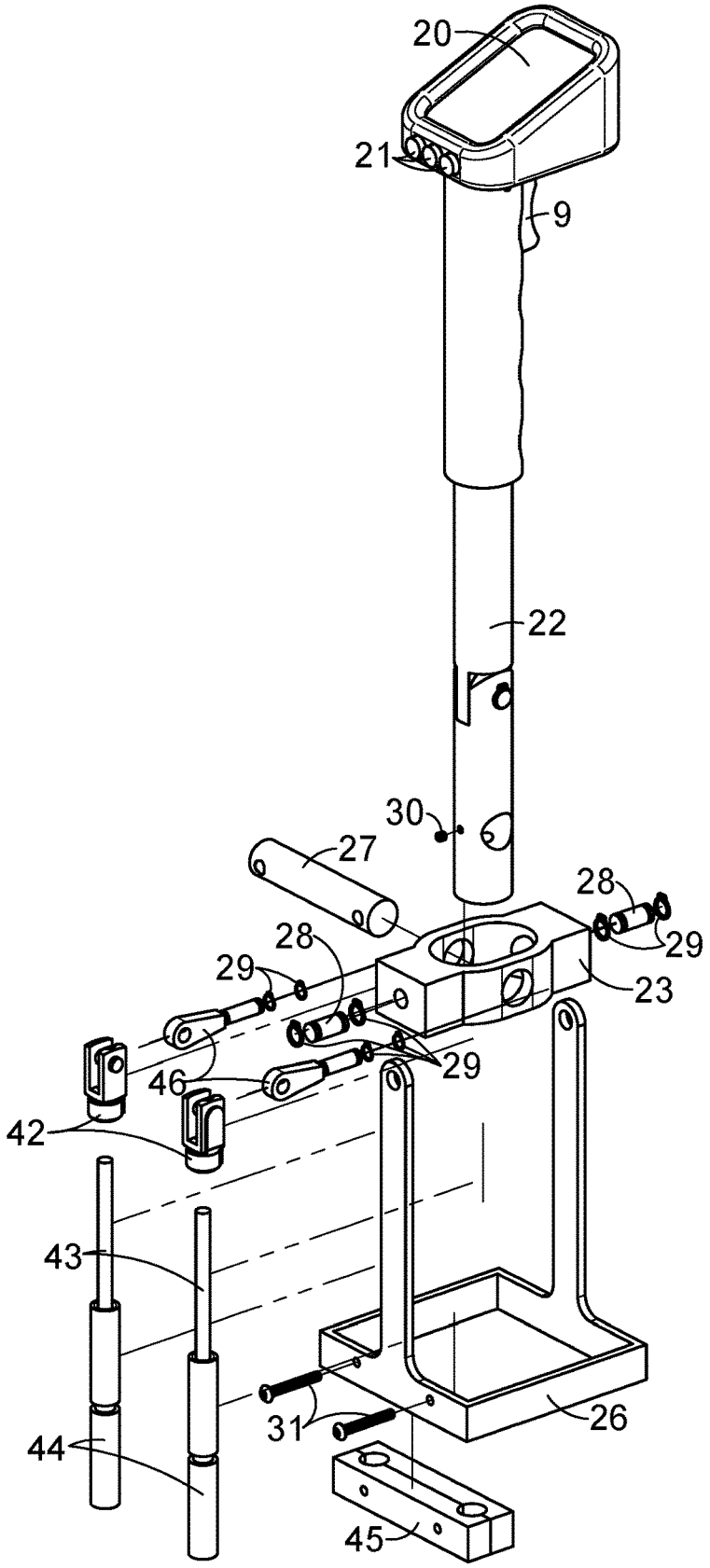

In another embodiment, FIGS. 13A through 13E show the mechanical version of the mounted joystick 12, which operates two push-pull cables, which intern operated the left and right steering fins 6 and 7 respectively. FIG. 13A show the mechanical joystick controller assembled, in the neutral position. FIG. 13B shows an exploded view of the mechanical mounted joystick 12 with the push-pull cables.

The mounting frame base 26 has two holes at the base, which attach the clamp 45 that holds the outer casings 44 of the two push-pull cables. Screws 31 hold the clamp 45 to the frame base 26. At the top of the mounting frame base 26 are two holes, which each hold the left-right roll shafts 28, which are held in place with snap rings 29. The two left-right roll shafts 28 hold the yoke 23, and allow left and right rotation of the yoke 23. The up-down shaft 27 is held within the yoke 23, but allowed to rotate. Attached at the center of the up-down shaft 27, within the yoke 23, is the folding joystick assembly 22, which is securely attached to the shaft 27 with a setscrew 30. This allows the joystick assembly 22 and up-down shaft 27 to rotate back and forth. At both ends of the up-down shaft 27 are holes, which accept two rotational horns 46, which are held in place with snap rings 29. The rotational horns 46 are free to rotate in the holes of the up-down shaft 27, when the joystick assembly 22 is tilted left or right. The two rotational horns 46 are each connected to a clevis 42, which in turn are connected to the ends of the two push-pull inner cable 43 ends.

Figure 4C:
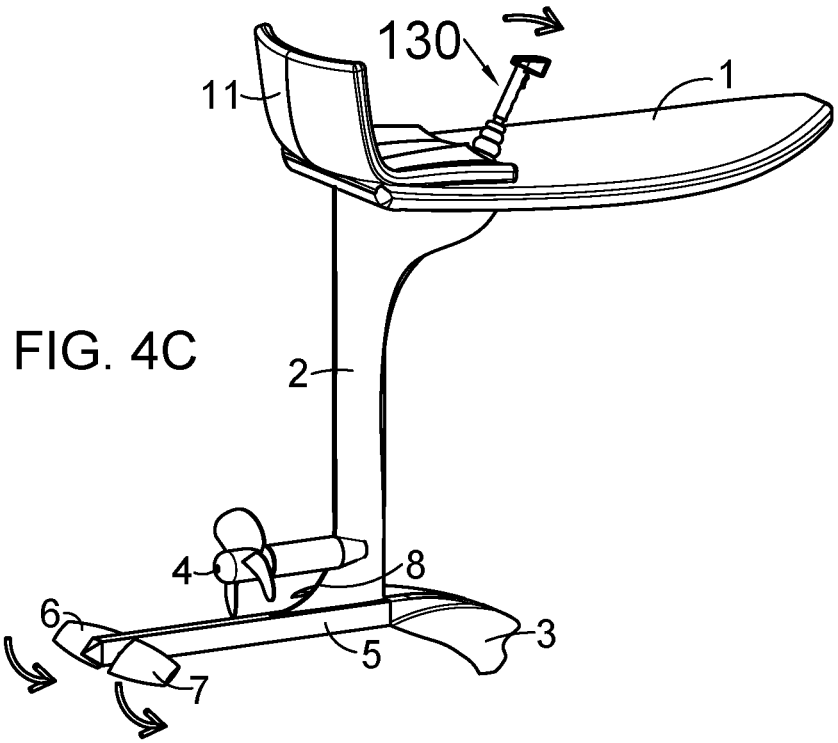
Figure 4D:
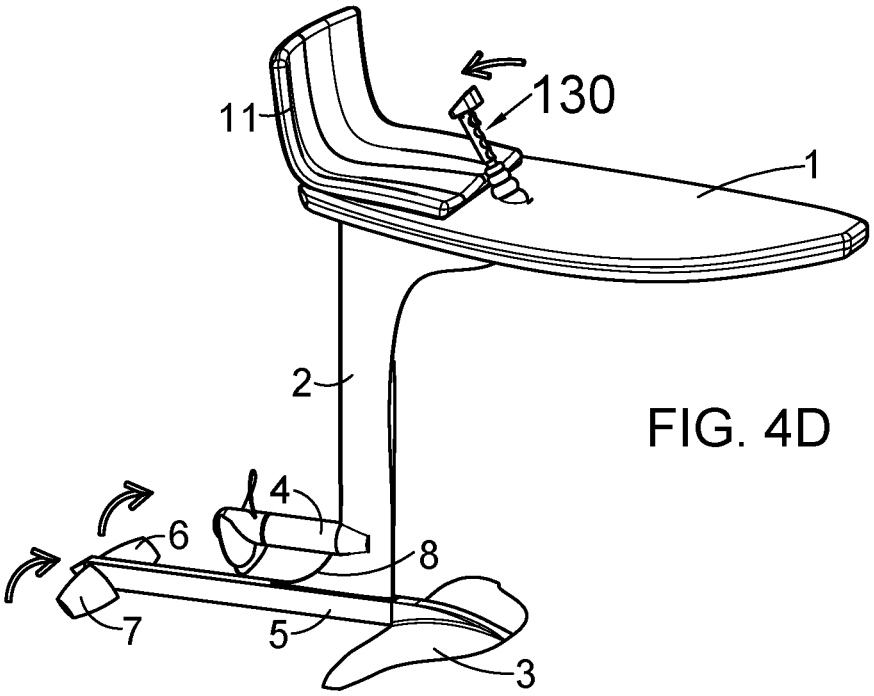
Figure 13C:
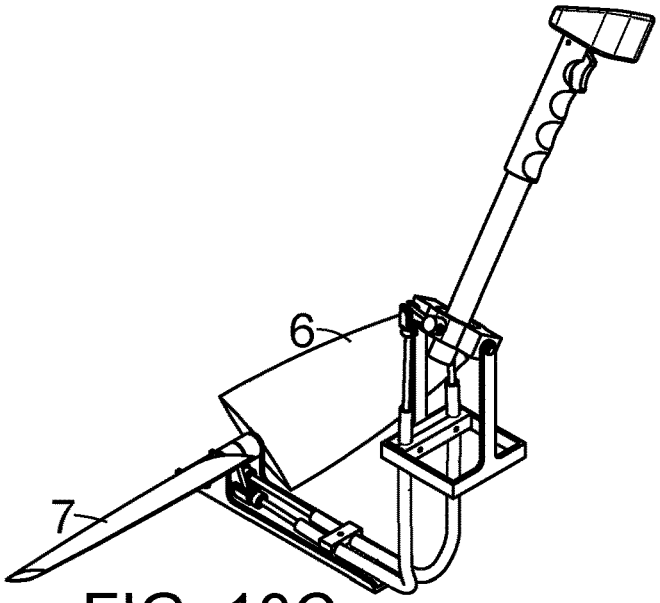
Figure 13D:
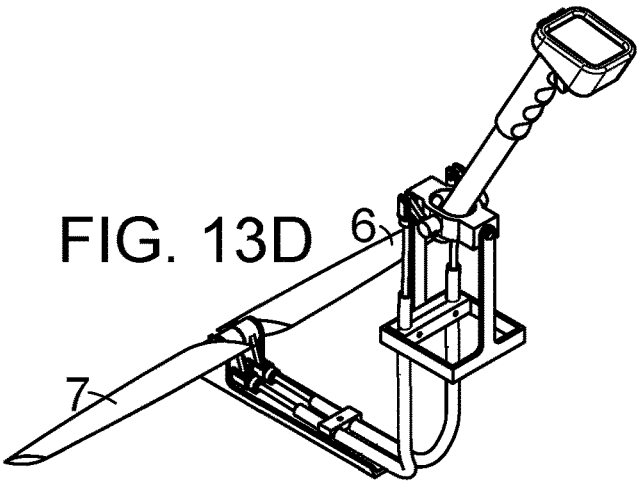
Figure 13E:
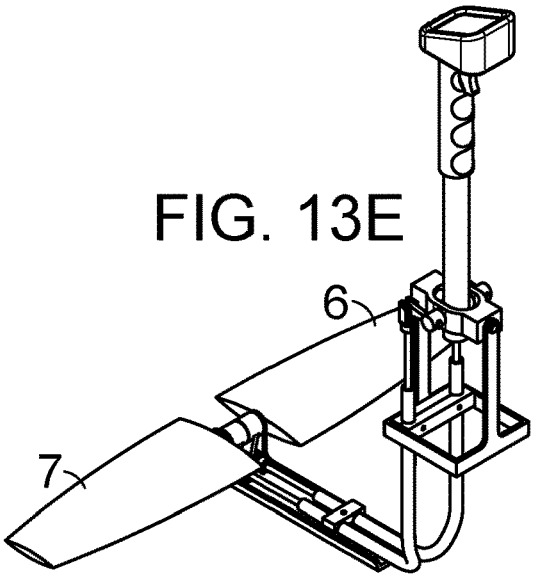

FIG. 13C shows the joystick 12 tilted to the left and resulting movement of the left and right steering fins 6 and 7 respectively; same as shown in FIG. 4A. FIG. 13D shows the joystick 12 tilted forward and the resulting movement of the left and right steering fins 6 and 7 respectively; same as shown in FIG. 4C. FIG. 13E shows the joystick 12 and steering fins in the neutral position.

Figure 14A:
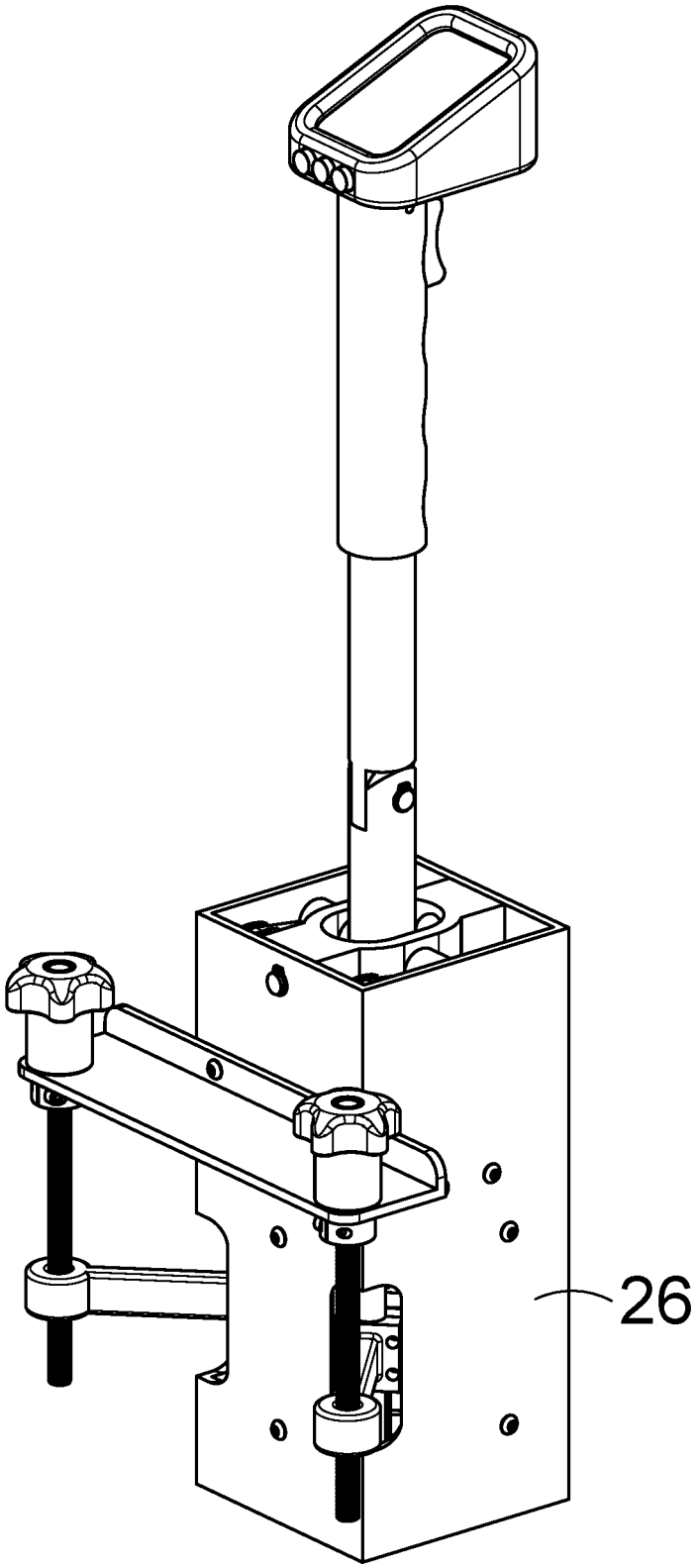
FIGS. 14A-14C illustrate mounted joystick control (both for the electronic and mechanical versions) with the addition of a spring to return the joystick to a vertical neutral position; and a trim adjustment for the mechanical version.
Figure 14B:
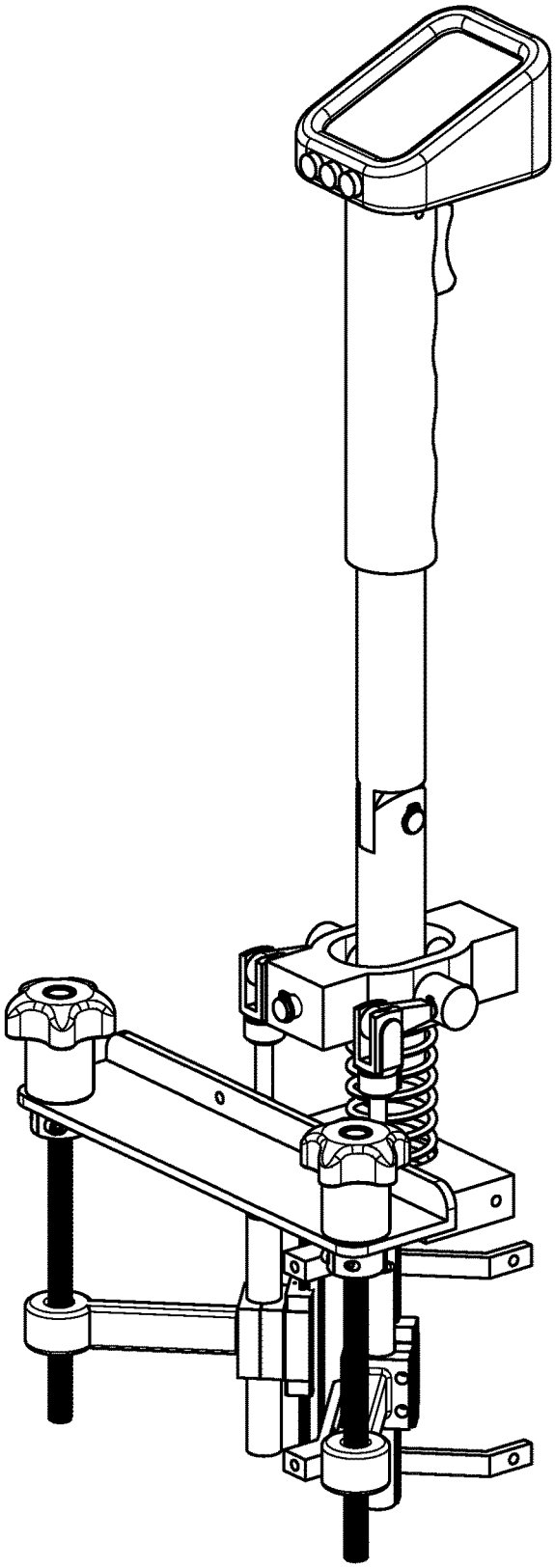
Figure 14C:
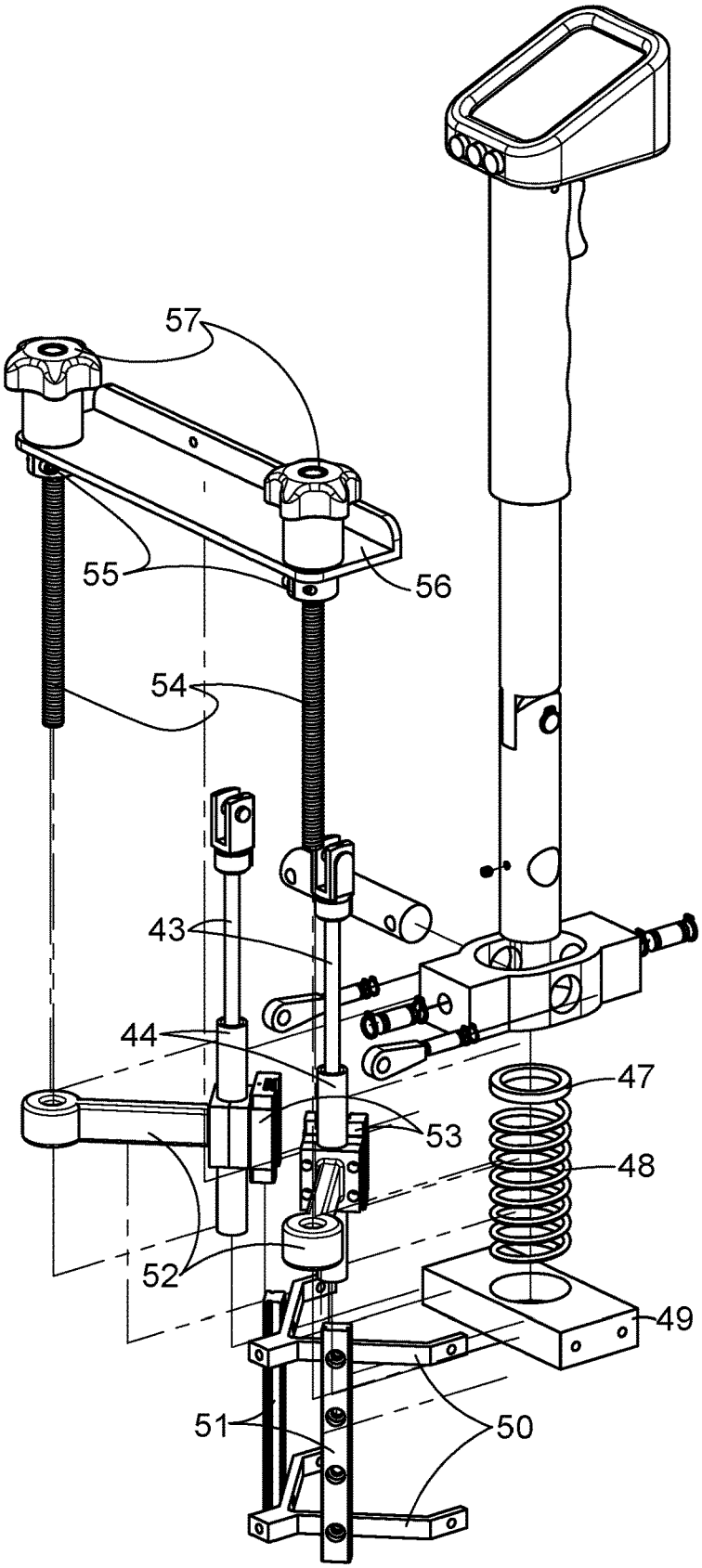
Figure 15E:
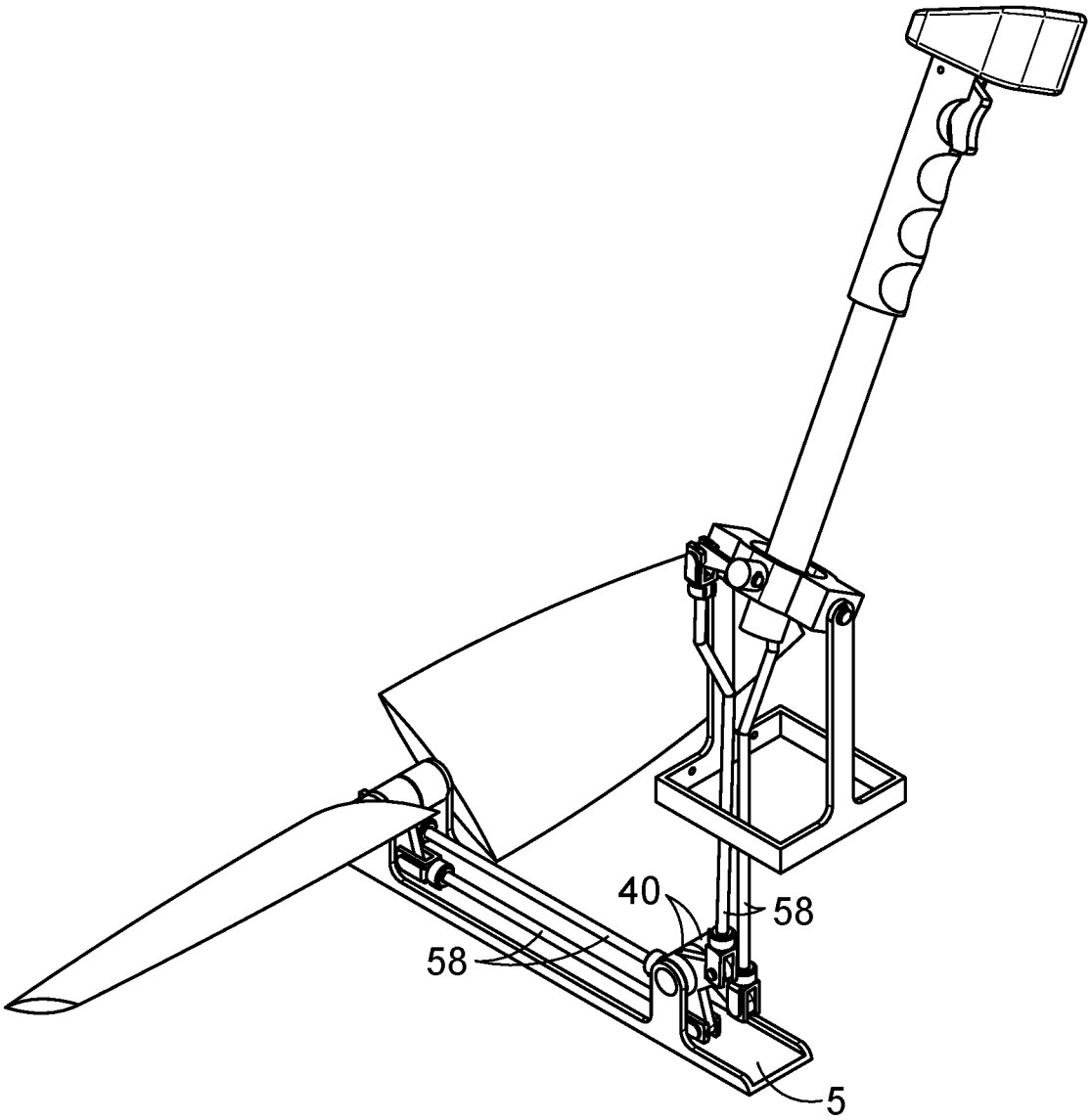
Figure 15F:
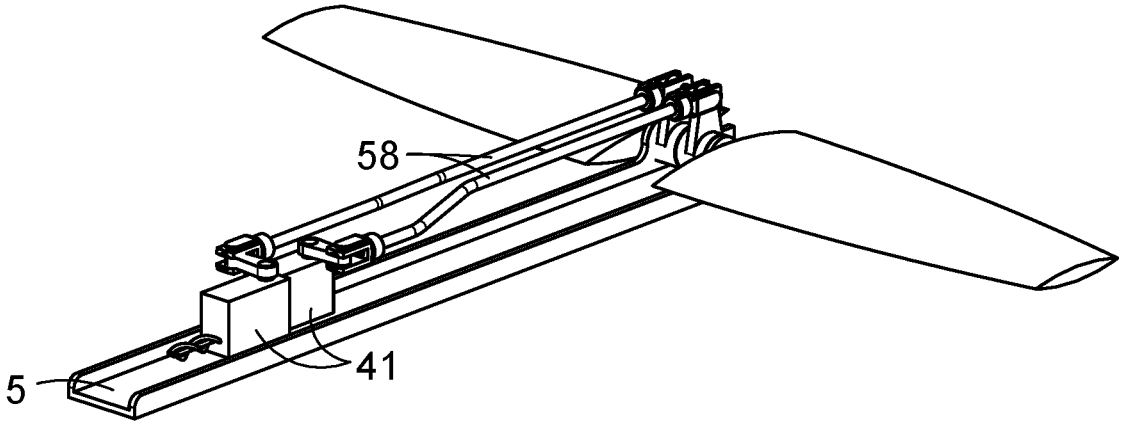

In another embodiment, FIGS. 14A through 14C show the mounted joystick 12, with additional hardware (47-49) to return the joystick to the vertical neutral position, which is for both the electronic version in FIGS. 10A-10B and the mechanical version in FIGS. 13A-13E. Also shown in FIGS. 14A-14C is additional hardware (50-57) for the trim adjustment of the mechanical version in FIGS. 13A-13E.

FIG. 14A shows the assembled unit with a larger frame base 26 and the addition of trim adjustment hardware. FIG. 14B show the assembled unit without the frame base 26 and screws 31. FIG. 14C is an exploded view of FIG. 14B.

In FIG. 14C additional hardware to return the joystick 12 to the vertical neutral position includes the spring top collar 47, the spring 48, and the spring base support 49. The spring top collar 47 and the spring 48 both slide onto the bottom of the lower joystick 36. The spring base support 49 compresses and holds the spring top collar 47 and spring 48 on the lower joystick 36. The spring base support 49 is held in place by the frame base 26.

FIG. 14C illustrates additional hardware for the trim adjustment of the mechanical version in FIGS. 13A-13E, which includes items 50 through 57. Trim adjustment is accomplished by moving the push-pull outer casing 44 up or down, relative to the push-pull inner cable 43, which results in movement of the neutral position of the left or right steering fins. Guide rail brackets 50 are held in place and attached to the frame base 26. Stationary and attached to the guide rail brackets 50 are the linear bearing guide rails 51, in which the mounted linear bearings 53 slide up and down on. Attached to each mounted linear bearing 53 is the push-pull outer casing trim clamp 52, which holds the end of the push-pull outer casing 44. Lead screws 54 are used for up and down adjustment. Each lead screw 54 is held vertically in place by angle bracket 56, with a collar 55 under the bracket, and a knob 57 on top for adjustment. The angle bracket 56 is attached to the frame base 26. The lead screws 54 screw into the threaded holes at the end of the push-pull outer casing trim clamps 52.

In an embodiment, FIGS. 15A through 15F is an optional method for driving the moveable steering fins, which include alternate servo locations, rotational shafts 61, and bevel gears 59, worm gears 61, and the use of push rods 58.

In some embodiments, the hydrofoil watercraft has a hollow downward mast. Here, the downward mast houses at least one push-pull cable for actuating the moveable fins via the controller. Other embodiments include push-pull cables coupled to the fuselage.

Alternative embodiments may also include a water pick up, this can be positioned on the front end of the mast, right in front of a motor. Other hydrofoil watercraft may include a water-cooling system allowing electronics and components of the hydrofoil watercraft to cool the electronics.

The invention claimed is:

1. A hydrofoil watercraft system comprising:

a flotation device;

a downward mast extending from a bottom surface of the flotation device;

a fuselage coupled to or integrated with a bottom end of the downward mast, wherein the fuselage is generally at a base of the downward mast;

a foil wing extending from one front end of the fuselage;

a plurality of fins independently movable independent of one another, wherein at least two of the movable fins extend in opposite directions from one rear end of the fuselage, where the movable fins are used for steering the watercraft, wherein the plurality of fins are mounted directly on and supported by the fuselage; and a controller for receiving user input, wherein the controller drives the movable fins respectively based on the user input; wherein one of the movable fins is driven by the controller to rotate along a first axis while another of the movable fins is driven by the controller to rotate along a second axis, wherein the first axis and the second axis are substantially symmetrical with respect to the fuselage.

2. The hydrofoil watercraft system of claim 1, wherein the controller includes a joystick configured to be held by a user for receiving the user input, the joystick has:

a lower joystick;

an upper joystick movably connected with the lower joystick; and an elastic element disposed in the lower joystick and connected to one end of the upper joystick, wherein the elastic element is configured to maintain the upper joystick in a neutral position, to expand when pulled by the upper joystick under an external force to be moved from the neutral position, or to retract to return the upper joystick to the neutral position.

3. The hydrofoil watercraft system of claim 1, wherein the controller includes:

a joystick configured to be moved by a user;

a position sensor configured to generate position signals corresponding to movements of the joystick by the user; and a fin driving system connected to the position sensor and the movable fins, wherein the fin driving system respectively drives the movable fins based on the position signals from the position sensor.

4. The hydrofoil watercraft system of claim 3, wherein the position sensor includes:

a first position sensor configured to generate first position signals corresponding to the movements of the joystick along a first axis;

a second position sensor configured to generate second position signals corresponding to the movements of the joystick along a second axis;

a microcontroller connected to the first position sensor to receive the first position signals and the second position sensor to receive the second position signals, wherein the microcontroller controls the fin driving system to drive the movable fins based on the first and second position signals.

5. The hydrofoil watercraft system of claim 4, wherein the movable fins includes a first fin and a second fin, the fin driving system includes a first servo connected to the first fin and a second servo connected to the second fin; wherein the microcontroller commands the first servo to move the first fin and the second servo to move the second fin based on the position signals.

6. The hydrofoil watercraft system of claim 1, further comprising a fin driving system, the controller including:

a joystick configured to be moved by a user; and a joystick controller coupled with the joystick and configured to command the fin driving system to drive movable fins based on movements of the joystick.

7. The hydrofoil watercraft system of claim 6, the movable fins including a first fin and a second fin, the fin driving system including a first servo connected to the first fin and a second servo connected to the second fin, wherein the a joystick controller includes:

a base;

a joystick seat coupled to the joystick and rotatably connected to the base;

a first transferor and a second transferor movably coupled with the joystick seat, wherein the first transferor commands the first servo to move the first fin based on the movements of the joystick, the second transferor commands the second servo to move the second fin based the movements of the joystick.

8. The hydrofoil watercraft system of claim 1, wherein the movable fins include a first fin having a first fin gear and a second fin having a second fin gear, the controller has:

a first driving gear coupled with the first fin gear, wherein the controller drives the first driving gear to rotate the first fin gear based on the user input; and a second driving gear coupled with the second fin gear, wherein the controller drives the second driving gear to rotate the second fin gear based on the user input.

9. The hydrofoil watercraft system of claim 1, wherein the movable fins include a first fin and a second find, the controller has:

a first rod coupled with the first fin and configured to rotate the first fin based on the user inputs; and a second rod coupled with the second fin and configured to rotate the second fin based on the user inputs.

10. The hydrofoil watercraft system of claim 1, wherein each of the movable fins has at least a first neutral position and a second neutral position, the controller includes a neutral position adjuster coupled with the movable fins, the controller command the neutral position adjuster to switch the movable fin between different neutral positions.

11. The hydrofoil watercraft system of claim 1, wherein the movable fin includes:

a fin body; and a flap movably coupled with the fin body.

12. The hydrofoil watercraft system of claim 1, further comprising a vertical fin extending from the second end of the fuselage for steering the watercraft, wherein the vertical fin are substantially perpendicular to the movable fins.

13. A method of steering a hydrofoil watercraft, the method comprising the steps of (i) providing a hydrofoil watercraft including:

a flotation device, a downward mast extending from a bottom surface of the flotation device, a fuselage connected to or integrated with a bottom end of the downward mast, a foil wing extending from a front end of the fuselage, a plurality of fins independently movable relative to one another, wherein at least two of the movable fins extend in opposite directions from one rear end of the fuselage, where the movable fins are used for steering the watercraft, wherein the plurality of fins are mounted directly on and supported by the fuselage; and a controller for receiving user input, wherein the controller is in communication with the one or more independently movable fins; and (ii) using the controller to drive one of the movable fins to rotate along a first axis and another of the movable fins to rotate along a second axis, wherein the first axis and the second axis are substantially symmetrical with respect to the fuselage.

14. The method of claim 13, wherein the step of providing the hydrofoil watercraft includes:

using a joystick of the controller to be held by a user for receiving the user input, wherein the joystick has:

a lower joystick; and an upper joystick movably connected with the lower joystick; and disposing a spring plunger in the lower joystick and connecting the spring plunger to one end of the upper joystick to maintain the upper joystick in a neutral position, expand when pulled by the upper joystick under an external force to be moved from the neutral position, or retract to return the upper joystick to the neutral position.

15. The method of claim 13, further comprising:

providing a joystick configured to be moved by a user;

using a position sensor with the joystick to generate position signals corresponding to movements of the joystick by the user;

connecting a fin driving system to the position sensor and the movable fins;

using the fin driving system to drive the movable fins respectively based on the position signals.

16. The method of claim 15, wherein the step of generating the position signals includes:

using a first position sensor to generate first position signals corresponding to the movements of the joystick along a first axis;

using a second position sensor to generate second position signals corresponding to the movements of the joystick along a second axis; and controlling the fin driving system to move the movable fins based on the first and second position signals.

17. The method of claim 16, wherein the step of moving the movable fins includes:

connecting a first servo of the fin driving system to a first fin of the movable fins;

connecting a second servo of the fin driving system to a second fin of the movable fins;

commanding the first servo to move the first fin based on the first position signals; and commanding the second servo to move the second fin based on the second position signals.

18. The method of claim 13, wherein the step of driving the movable fins includes:

coupling a joystick seat to a base;

coupling a joystick to the joystick seat to be moved by a user;

coupling a first transferor and a second transferor to the joystick seat;

using the first transferor to drive a first fin of the movable fin based on movements of the joystick by the user; and using the second transferor to drive a second fin of the movable fin based on movements of the joystick by the user.

19. The method of claim 13, wherein the movable fins include a first fin and a second fin, the step of driving the movable fins includes:

connecting a first driving gear of the controller to a first fin gear of the first fin;

driving the first driving gear to rotate the first fin gear based on the user input;

connecting a second driving gear of the controller to a second fin gear of the second fin; and driving the second driving gear to rotate the second fin gear based on the user input.

20. The method of claim 13, further comprising:

connecting a neutral position adjuster to the movable fins;

receiving a user input via a user interface in communication with the controller; and moving the movable fin between different neutral positions based on the user input.

* * * * *